US009979123B2

(12) United States Patent
Sekino et al.

(10) Patent No.: US 9,979,123 B2
(45) Date of Patent: May 22, 2018

(54) CONNECTOR WITH FITTING DETECTION MEMBER

(71) Applicant: YAZAKI CORPORATION, Tokyo (JP)

(72) Inventors: Tetsuya Sekino, Shizuoka (JP); Nobuyuki Sakamoto, Shizuoka (JP); Toshinori Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/652,409

(22) Filed: Jul. 18, 2017

(65) Prior Publication Data

US 2018/0034201 A1 Feb. 1, 2018

(30) Foreign Application Priority Data

Jul. 29, 2016 (JP) ..... 2016-149209

(51) Int. Cl.
*H01R 13/641* (2006.01)
*H01R 13/62* (2006.01)
(Continued)

(52) U.S. Cl.
CPC ..... *H01R 13/62* (2013.01); *H01R 13/4368* (2013.01); *H01R 13/502* (2013.01);
(Continued)

(58) Field of Classification Search
CPC H01R 13/641; H01R 13/6272; H01R 13/639; H01R 13/7031; H01R 13/502; H01R 13/2464; H01R 13/28; H01R 13/4368; H01R 13/62; H01R 24/28; H01R 13/26; H01R 13/4223; H01R 13/426; H01R 13/428; H01R 13/508; H01R 13/516; H01R 13/6271; H01R 13/6278; H01R 13/62955;
(Continued)

(56) References Cited

U.S. PATENT DOCUMENTS 6,435,895 B1 * 8/2002 Fink ..... H01R 13/6272 439/352
6,568,954 B2 * 5/2003 Endo ..... H01R 13/641 439/352
(Continued)

FOREIGN PATENT DOCUMENTS

JP 2012-074190 A 4/2012

*Primary Examiner* — Michael A Lyons
*Assistant Examiner* — Matthew T Dzierzynski
(74) *Attorney, Agent, or Firm* — Sughrue Mion, PLLC

(57) ABSTRACT

An engagement member mounted to a first housing with a fitting detection member located at a complete engagement position is located at a correct position with a terminal correctly housed in the first housing and is located at an incorrect position with the terminal incorrectly housed in the first housing. The engagement member located at the correct position does not interfere with the fitting detection member and allows a movement of the fitting detection member from the complete engagement position to a temporary engagement position. The engagement member located at the incorrect position interferes with the fitting detection member and prevents the movement of the fitting detection member from the complete engagement position to the temporary engagement position.

3 Claims, 17 Drawing Sheets

(51) Int. Cl.
*H01R 13/502* (2006.01)
*H01R 24/28* (2011.01)
*H01R 13/436* (2006.01)
*H01R 103/00* (2006.01)

(52) U.S. Cl.
CPC ..... *H01R 13/641* (2013.01); *H01R 24/28* (2013.01); *H01R 2103/00* (2013.01)

(58) Field of Classification Search
CPC ..... H01R 13/6392; H01R 13/6397; H01R 13/642
See application file for complete search history.

(56) References Cited

U.S. PATENT DOCUMENTS 6,824,417 B1 * 11/2004 Nimura ..... H01R 13/641 439/352
7,043,834 B2 * 5/2006 Endo ..... H01R 13/641 29/842
7,559,787 B2 * 7/2009 Shigeta ..... H01R 13/6272 439/358
8,747,146 B2 * 6/2014 Brown ..... H01R 13/641 439/489
8,926,356 B2 * 1/2015 Kon ..... H01R 13/6272 439/352
9,054,458 B1 * 6/2015 Ng ..... H01R 13/641
9,160,095 B2 * 10/2015 Littek ..... H01R 13/422
9,231,346 B2 * 1/2016 Okano ..... H01R 13/6272
9,300,084 B2 * 3/2016 Wimmer ..... H01R 13/639
9,350,116 B1 * 5/2016 Morello ..... H01R 13/639
9,425,534 B2 * 8/2016 Schmidt ..... H01R 13/6272
9,490,576 B2 * 11/2016 Plazio ..... H01R 13/641
9,515,410 B2 * 12/2016 Tanikawa ..... H01R 13/641
9,543,687 B2 * 1/2017 Horiuchi ..... H01R 13/502
9,831,601 B2 * 11/2017 Kim ..... H01R 13/639
2002/0173197 A1 * 11/2002 Endo ..... H01R 13/641 439/489
2003/0003792 A1 * 1/2003 Endo ..... H01R 13/6272 439/352
2004/0067676 A1 * 4/2004 Nimura ..... H01R 13/6272 439/352
2004/0185700 A1 * 9/2004 Endo ..... H01R 13/6272 439/352
2011/0023274 A1 * 2/2011 Urano ..... H01R 13/6272 24/591.1
2017/0250492 A1 * 8/2017 Endo ..... H01R 13/508
2018/0026396 A1 * 1/2018 Ohtaka ..... H01R 13/4367
2018/0034180 A1 * 2/2018 Sekino ..... H01R 13/28
2018/0034184 A1 * 2/2018 Sekino ..... H01R 13/428
2018/0034187 A1 * 2/2018 Sekino ..... H01R 13/4368
2018/0034203 A1 * 2/2018 Sekino ..... H01R 13/6272
2018/0034206 A1 * 2/2018 Sekino ..... H01R 13/639
2018/0034210 A1 * 2/2018 Sekino ..... H01R 13/641

* cited by examiner

CONNECTOR WITH FITTING DETECTION MEMBER

CROSS REFERENCE TO RELATED APPLICATION

This application is based upon and claims the benefit of priority from the prior Japanese Patent Application No. 2016-149209, filed on Jul. 29, 2016, the entire contents of which are incorporated herein by reference.

BACKGROUND

1. Technical Field

The disclosure relates to a connector, and more particularly, to a connector including a first housing capable of housing a terminal; a second housing capable of housing a mating terminal; and a fitting detection member capable of detecting a fitted state between the first housing and the second housing.

2. Related Art

Conventionally, a connector including a fitting detection member has been proposed. For example, one (hereinafter, referred to as an 'conventional connector') of the conventional connectors includes a male housing capable of housing a male terminal, a female housing capable of housing a female terminal, and a fitting detection member capable of detecting engagement (i.e., fitting of the connector) between a fitting lock arm extended from the female housing and a fitting protrusion protruding from the male housing. The conventional connector has a structure in which a protrusive piece-shaped regulator extended from the fitting detection member is located at a position interfering with the fitting lock arm to prevent the fitting between the fitting lock arm and the fitting protrusion from being unintentionally released (prevent the fitting lock arm from being far away from the fitting protrusion). JP 2012-74190 A proposes such a connector.

SUMMARY

The conventional connector has a structure in which the fitting detection member can be separated from the housing by pulling the fitting detection member toward a rear of a fitted direction with a force larger than a predetermined engagement force in consideration of workability or the like when the fitting is intentionally released.

For this reason, the conventional connector is excellent in workability when the fitting is released, but has a problem in that the fitting detection member may be unintentionally separated from the housing when excessively large external forces (impact, vibration and the like exceeding the engagement force) are applied to the fitting detection member. Even if the fitting detection member is unintentionally separated in this way, a fitted state of the connector is maintained by an elastic force of the fitting lock arm, such that the fitting of the connector is not directly released. However, if the external force is applied to the fitting lock arm in the state in which the fitting detection member is separated, the fitting lock arm is deflected, such that the fitting of the connector may be released.

For this reason, countermeasures such as devising a location of the conventional connector so as not to apply the external force to the fitting detection member well may be required depending on an use environment of the conventional connector. As a result, it has become difficult to improve the workability when the conventional connector is used.

Furthermore, the conventional connector does not have a mechanism that detects whether or not a terminal is correctly housed in a housing (for example, whether or not there is a so-called halfway insertion terminal). For this reason, countermeasures such as checking a housed state of the terminal with the naked eye may be required. As a result, as described above, it has become difficult to improve the workability when the conventional connector is used.

An object of the disclosure is to provide a connector in which a fitted state of the connector can be detected, unintentional release of fitting of the connector can be prevented, and a housed state of a terminal can be detected.

A connector in accordance with some embodiments includes: a first housing configured to house a terminal; a second housing configured to house a mating terminal and fittable with the first housing; a fitting detection member mounted from a rear of the first housing in a first direction in which the first housing approaches the second housing in a fitted direction between the first housing and the second housing, the fitting detection member being configured to detect a fitted state between the first housing and the second housing; and an engagement member mounted to the first housing and configured to engage the terminal housed in the first housing. The first housing includes: a fitting lock arm extending toward a second direction opposite to the first direction; a first locking part provided in the fitting lock arm and engageable with the fitting detection member; and a second locking part provided in the fitting lock arm and engageable with the second housing. The fitting detection member includes: a detection lock arm extending toward the first direction; a detection protrusion provided in the detection lock arm; a deflection regulator configured to regulate a deflection amount of the fitting lock arm; and a first locked part engageable with the first locking part. The second housing includes a second locked part engageable with the second locking part. The fitting detection member is movable between a temporary engagement position and a complete engagement position, the temporary engagement position at which a contact between the detection protrusion and the second locking part prevents a movement of the fitting detection member in the first direction, the complete engagement position to which the fitting detection member moves from the temporary engagement position in the first direction and at which the first locked part is engaged with the first locking part. The second locked part engaged with the second locking part releases the contact between the detection protrusion and the second locking part located at the temporary engagement position and allows the fitting detection member to move in the first direction. The deflection regulator of the fitting detection member located at the complete engagement position regulates the deflection amount of the fitting lock arm within a range in which an engagement between the second locking part and the second locked part is unreleasable while an engagement between the first locking part and the first locked part is releasable. The engagement member mounted to the first housing with the fitting detection member located at the complete engagement position is located at a correct position with the terminal correctly housed in the first housing and is located at an incorrect position with the terminal incorrectly housed in the first housing. The engagement member located at the correct position does not interfere with the fitting detection member and allows a movement of the fitting detection member from the complete engagement position to the temporary engagement position. The engagement member located at the incorrect position interferes with the fitting detection member and prevents the movement of the fitting detection member from the complete engagement position to the temporary engagement position.

According to the above configuration, when the connector is fitted, if the fitting detection member approaches a second housing in a state in which the fitting detection member is at a temporary engagement position (position at which forward movement of the fitting detection member is prevented), a first housing also approaches the second housing along with the fitting detection member, such that the first housing and the second housing are fitted with each other. Further, of the contact between the detection protrusion and the second locking part is released according to the fitting, such that the fitting detection member can move forward. For this reason, a fitted state between the first housing and the second housing can be detected depending on a position of the fitting detection member (in detail, whether the fitting detection member is at the temporary engagement position or whether the fitting detection member moves forward from the temporary engagement position).

Further, when the fitting detection member is at a complete engagement position (position at which the fitting detection member and the first housing are engaged with each other), a deflection amount of the fitting lock arm is regulated by a deflection regulator so as to be in a range in which engagement of the first locking part can be released but engagement of the second locking part cannot be released. For this reason, when the fitting is intentionally released, the fitting lock arm is deflected to release engagement between the fitting detection member and the first housing (engagement between the first locking part and a first locked part), and then move the fitting detection member from the complete engagement position toward the temporary engagement position, and the fitting lock arm is deflected to release engagement between the first housing and the second housing (engagement between the second locking part and a second locked part). In other words, when the fitting of the connector is released, two operations of releasing (first releasing) the engagement between the fitting detection member and the first housing and releasing (second releasing) the engagement between the first housing and the second housing are performed. Therefore, in the connector having the above configuration, the unintentional release of the fitting of the connector can be more certainly prevented as compared with the conventional connector.

Furthermore, according to the connector having the present configuration, the engagement member is mounted to the first housing in a state in which the fitting detection member is temporarily located at the complete engagement position, and the fitting detection member can move from the complete engagement position to the temporary engagement position (return to the temporary engagement position before the fitting) only when the terminal is correctly housed (inserted) in the first housing. On the other hand, when the terminal is incorrectly housed (inserted) in the first housing, the engagement member interferes with the fitting detection member, such that the fitting detection member cannot move from the complete engagement position to the temporary engagement position. Therefore, in the connector having the present configuration, it is possible to detect whether or not the terminal is correctly housed in the first housing (for example, whether or not there is the halfway insertion terminal) depending on whether or not the fitting detection member can move from the complete engagement position to the temporary engagement position.

When the engagement member is configured to engage the terminal when the engagement member is at the correct position, it is possible to detect whether or not the engagement member certainly engages the terminal (whether or not an operator forgets engaging the terminals) by the above-mentioned principle.

Therefore, according to the configuration, the fitted state of the connector can be detected, unintentional release of the fitting can be prevented, and the housed state of the terminal can be detected.

By the way, the "first direction" (front in the fitted direction) refers to a direction in which the first housing moves (approaches the second housing) when the first housing engages with the second housing. Meanwhile, the "second direction" (rear in the fitted direction) refers to a direction in which the first housing moves (becomes far away from the second housing) when the engagement between the first housing and the second housing is released. The same goes for the fitting detection member and the second housing.

The fitting detection member may be inserted onto the first housing, and the fitting detection member located at the temporary engagement position may include a movement prevention part configured to prevent a movement of the engagement member from the correct position to the incorrect position.

According to the configuration, when the fitting detection member is at the temporary engagement position (in other words, when the engagement member is at the correct position and the fitting detection member can return from the complete engagement position to the temporary engagement position), the engagement member is held at the correct position. Therefore, in the connector having the present configuration, reliability in holding the terminal can improved as compared with the conventional connector.

The first housing may be configured to house a plurality of terminals, and the engagement member may be located at the incorrect position with at least one terminal of the plurality of terminals incorrectly housed in the first housing.

According to the configuration, only when all of the plurality of terminals housed in the first housing are correctly housed (inserted), the engagement member is located at the correct position. Therefore, in the connector having the present configuration, it is possible to detect whether all of the plurality of terminals housed in the first housing are correctly inserted.

DETAILED DESCRIPTION

Figure 1:
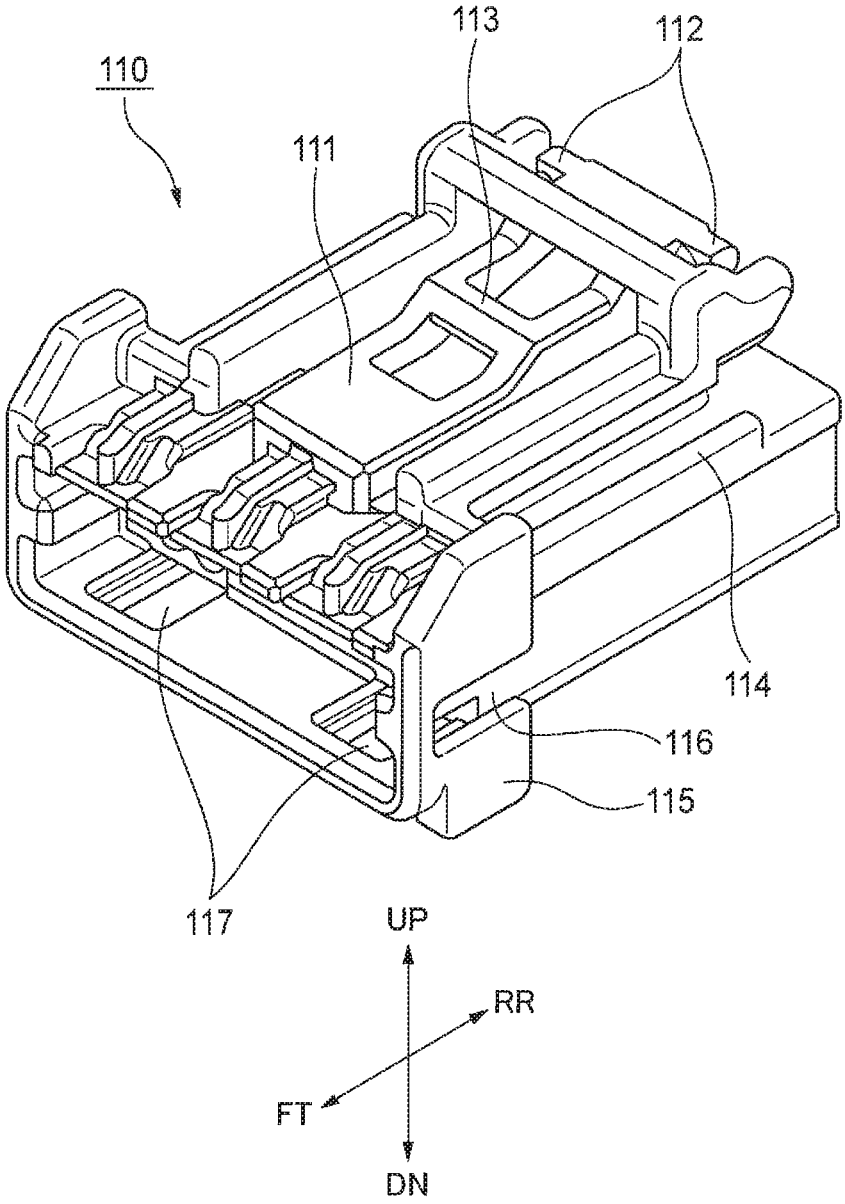
FIG. 1 is a schematic perspective view of a female housing according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Hereinafter, a connector 100 according to an embodiment of the present disclosure will be described with reference to FIGS. 1 to 18B.

Structure of Connector

As illustrated in FIGS. 1 to 18B (particularly, FIG. 6), a connector 100 includes a female housing (first housing) 110, a fitting detection member 120, a male housing (second housing) 130, female terminals 141, a male housing spacer (engagement member) 150, male terminals 161, and a male housing spacer 171. Hereinafter, for convenience of explanation, the female housing spacer 150 is simply referred to as a 'spacer 150'.

In FIGS. 1 to 18B, a direction in which the female housing 110 faces the male housing 130 is referred to as a front in a fitted direction, a direction opposite to the front is referred to as a rear in the fitted direction, and a height direction of the female housing 110 orthogonal to front and rear directions (i.e., fitted direction) is referred to as a vertical direction. Further, a direction going straight in the vertical direction while being orthogonal to the front and rear directions is referred to as a transversal direction. The same goes for front and rear directions, a vertical direction, and a transversal direction of other members (fitting detection member 120, male housing 130, spacer 150 and the like). It should be noted that, in FIGS. 1 to 4, an up direction, a down direction, a front direction, and a rear direction are denoted by UP, DN, FT, and RR, respectively.

As illustrated in FIG. 1, the female housing 110 has a tubular shape having openings formed at the front and the rear in the fitted direction. The female housing 110 has a fitting lock arm 111 extended toward the rear in the fitted direction. The fitting lock arm 111 has a cantilevered shape having a fixed end formed at the front in the fitted direction and a free end formed at the rear in the fitted direction. The female housing 110 includes fitting detection member engaging parts (first locking parts) 112 provided at an end of a free end side (rear side) of the fitting lock arm 111 and a male housing engaging part (second locking part) 113 provided at a fixed end side from the fitting detection member engaging parts 112.

The fitting detection member engaging part 112 is a member (protruding member) that can be engaged with the fitting detection member 120 when the connector 100 is fitted, and the male housing engaging part 113 is a member (pillar-shaped member) that can be engaged with the male housing 130 when the connector 100 is fitted.

Figure 16A:
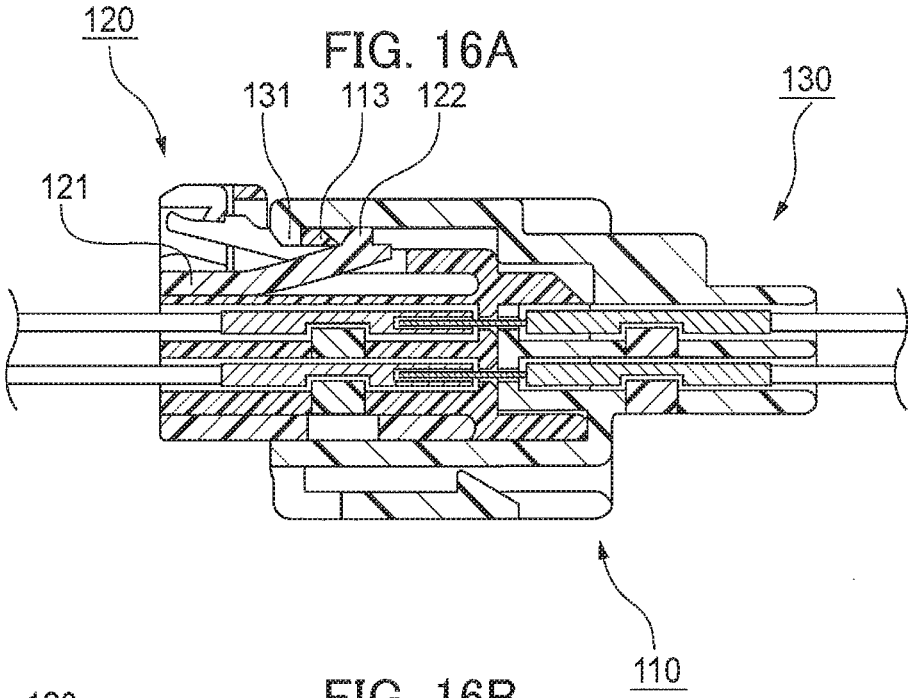
FIG. 16A is a cross-sectional view of the female housing and the fitting detection member, and the male housing in a state in which fitting of the female housing and the fitting detection member with the male housing is completed (a state in which the fitting detection member is at the complete engagement position), taken along line A-A of FIG. 4.
Figure 16B:
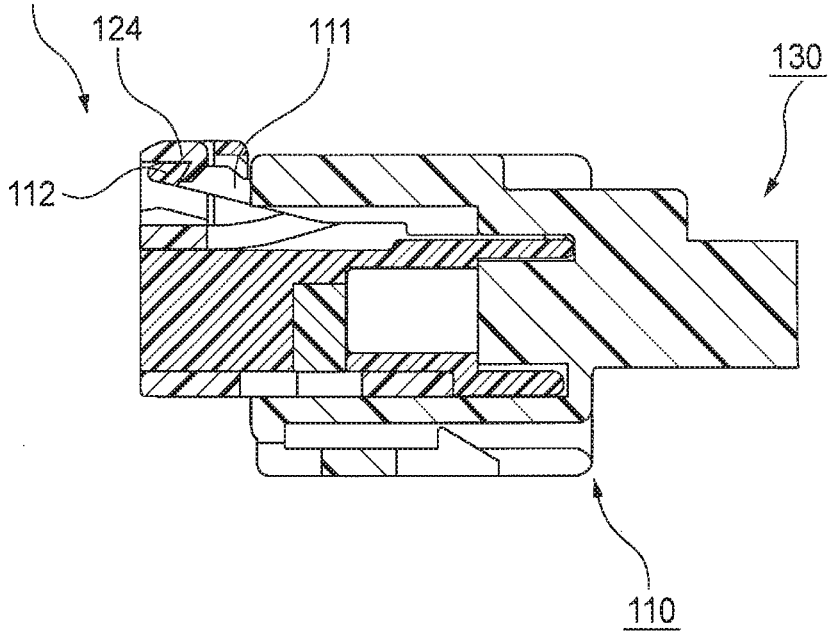
FIG. 16B is a cross-sectional view of the female housing and the fitting detection member, and the male housing in the state in which the fitting of the female housing and the fitting detection member with the male housing is completed (the state in which the fitting detection member is at the complete engagement position), taken along line B-B of FIG. 4.

Furthermore, side walls of the female housing 110 are provided with guide rails 114 for slidably mounting the fitting detection member 120 and abutting walls 115 onto which the fitting detection member 120 abuts (i.e. with which the fitting detection member 120 is in contact) when the fitting detection member 120 is at a complete engagement position (for example, see FIGS. 16A and 16B). The abutting walls 115 are provided with side wall groove portions 116. A lower wall of the female housing 110 is provided with lower wall groove portions 117.

Figure 2:
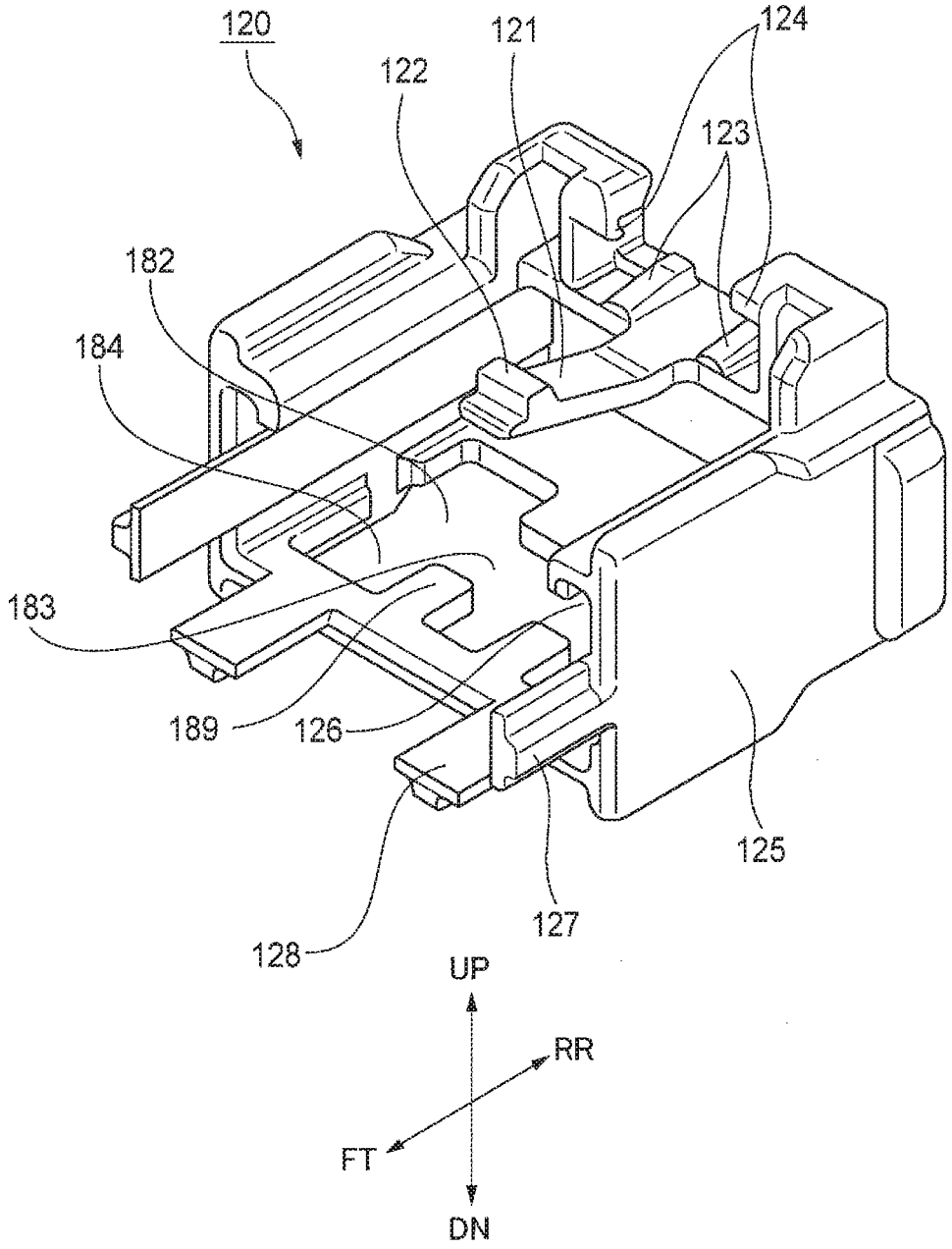
FIG. 2 is a schematic perspective view of a fitting detection member according to the embodiment.

As illustrated in FIG. 2, the fitting detection member 120 has a ring shape circulated around an axial line in the fitted direction (front and rear directions). The fitting detection member 120 has a detection lock arm 121 extended toward the front in the fitted direction. The detection lock arm 121 has a cantilevered shape having a fixed end formed at the rear in the fitted direction and a free end formed at the front in the fitted direction. The fitting detection member 120 includes a detection protrusion 122 provided near the free end of the detection lock arm 121, deflection regulators 123 capable of regulating a deflection amount of the fitting lock arm 111, and engaging parts (first locked parts) 124 corresponding to the fitting detection member engaging parts 112 of the female housing 110.

Further, side walls of the fitting detection member 120 are provided with abutting walls 125 abutting onto the abutting walls 115 of the female housing 110 when the fitting detection member 120 is at the complete engagement position, insertion holes 126 into which the guide rails 114 of the female housing 110 are inserted, and side wall protrusions 127 inserted into the side wall groove portions 116 of the abutting walls 115 of the female housing 110. A lower wall of the fitting detection member 120 is provided with lower wall protrusions 128 inserted into the lower wall groove portions 117 of the female housing 110. Explanations for elements of 182, 183, 184 and 189 illustrated in FIG. 2 are described later.

Figure 3:
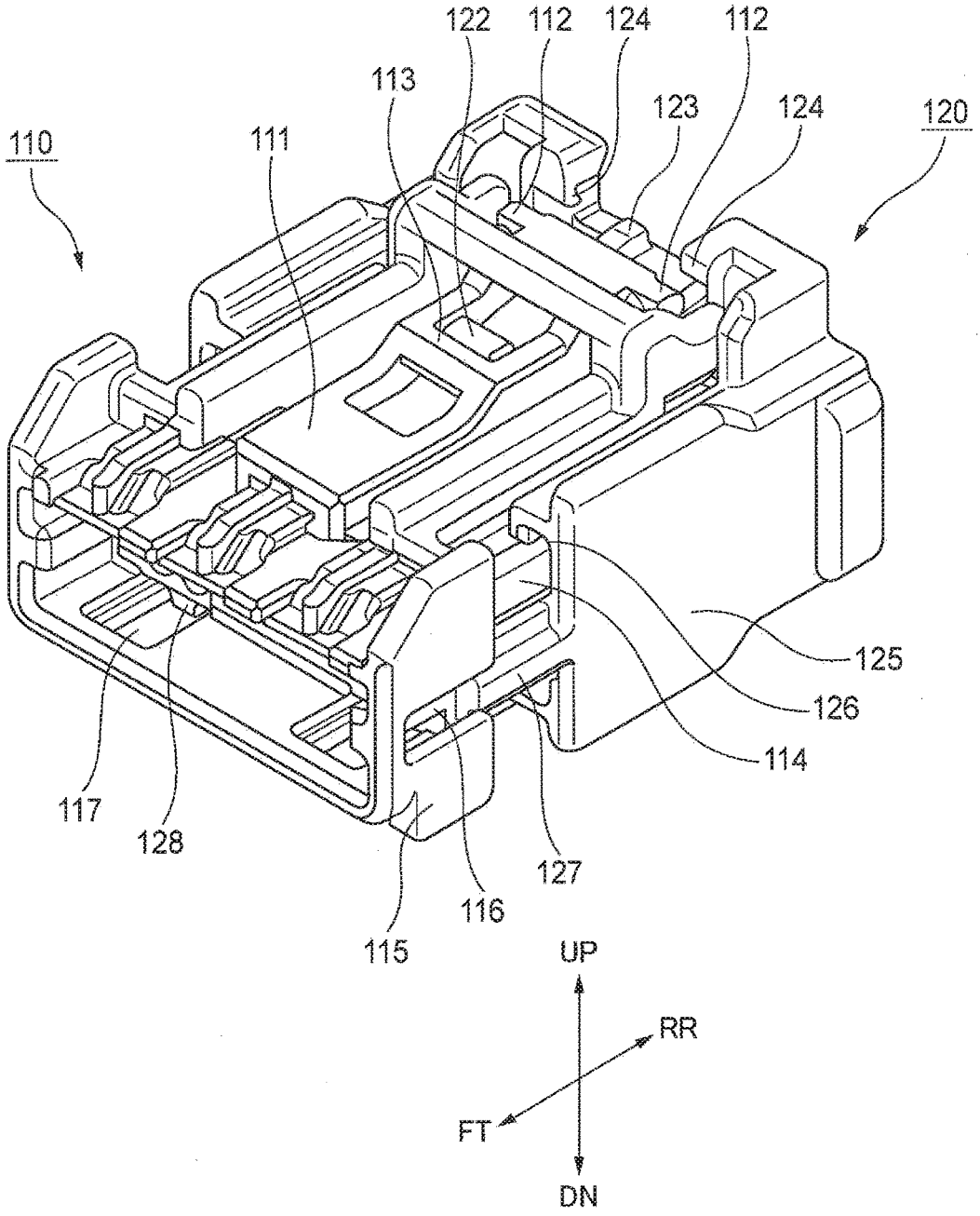
FIG. 3 is a schematic perspective view of a case in which the fitting detection member of FIG. 2 is mounted to the female housing of FIG. 1 (a case in which the fitting detection member is at a temporary engagement position).

As illustrated in FIG. 3, the fitting detection member 120 is mounted to the female housing 110 so as to be inserted onto the female housing 110 (or inserted on the exterior of the female housing 110) from a rear of the female housing 110. In FIG. 3, the detection protrusion 122 of the fitting detection member 120 abuts onto a rear wall surface of the male housing engaging part 113 of the female housing 110, such that a forward movement of the fitting detection member 120 is restricted. In other words, when the fitting detection member 120 is pushed forward in a state illustrated in FIG. 3, the fitting detection member 120 does not move forward (does not relatively move with respect to the female housing 110), but the female housing 110 itself moves forward.

If the fitting detection member 120 is at a position illustrated in FIG. 3, the fitting detection member engaging parts 112 of the female housing 110 and the engaging parts 124 of the fitting detection member 120 are separated from each other, and are not engaged with each other. In other words, the fitting detection member 120 is temporarily engaged with the female housing 110. Therefore, the position of the fitting detection member 120 illustrated in FIG. 3 is also referred to as a temporary engagement position.

Further, if the fitting detection member 120 is at the temporary engagement position as described above, the guide rails 114 of the female housing 110 are inserted into the insertion holes 126 of the sidewalls of the fitting detection member 120, distal ends of the side wall protrusions 127 of the fitting detection member 120 are inserted into the side wall groove portions 116 of the female housing 110, and distal ends of the lower wall protrusions 128 of the fitting detection member 120 are inserted into the lower wall groove portions 117 of the female housing 110. Therefore, even when the fitting detection member 120 is at the temporary engagement position, a displacement (wobble) between the female housing 110 and the fitting detection member 120 is suppressed.

In this case, the abutting walls 125 of the fitting detection member 120 do not abut onto the abutting walls 115 of the female housing 110. The abutting walls 125 of the fitting detection member 120 and the abutting walls 115 of the female housing 110 abut onto each other when the fitting detection member 120 moves to the complete engagement position (for example, see FIGS. 16A and 16B).

Figure 4:
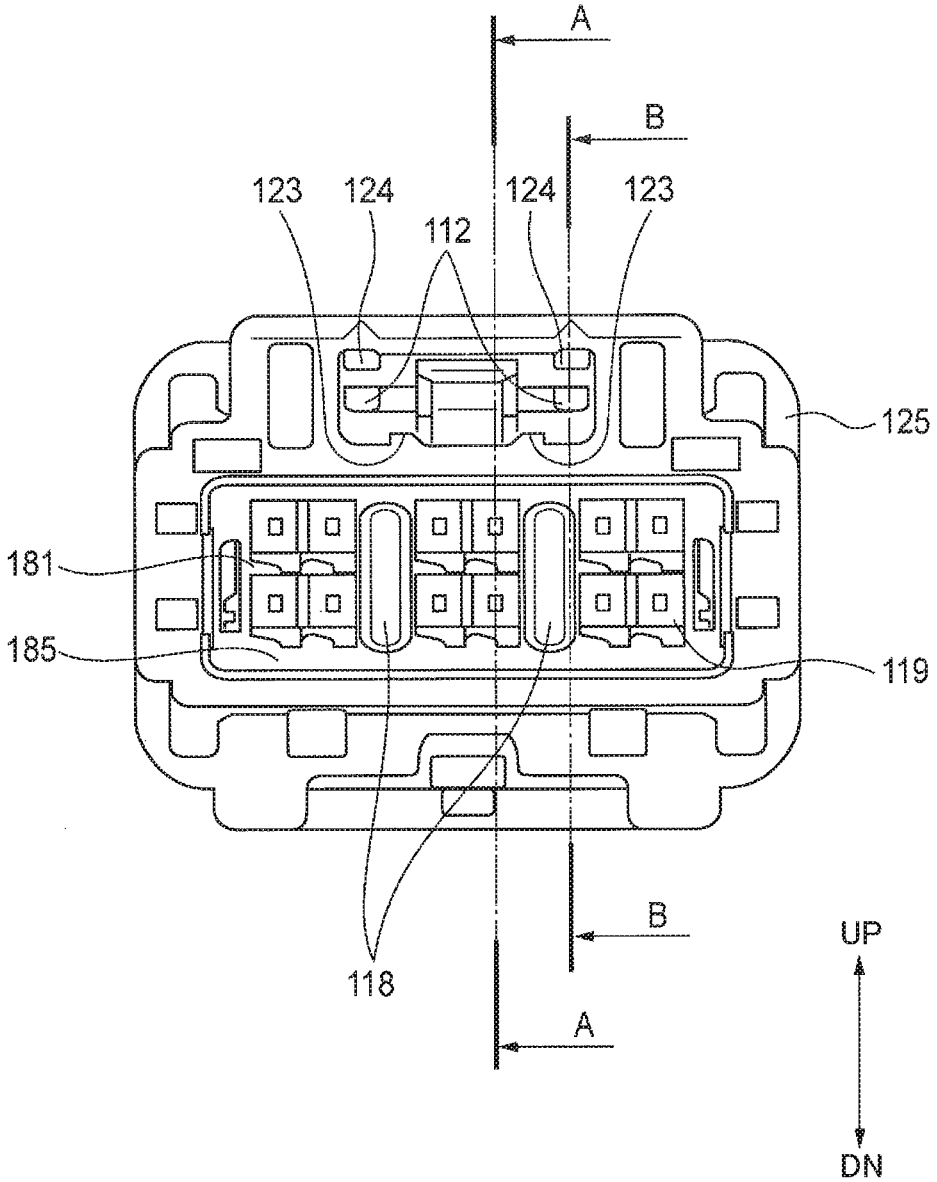
FIG. 4 is a rear view of the female housing and the fitting detection member of FIG. 3 viewed from a rear in a fitted direction.

As illustrated in FIG. 4, the female housing 110 has inner walls 118 that connect a lower wall and an upper wall thereof to each other, and has a plurality of terminal housing chambers 119 within areas divided by the inner walls 118. In detail, in the present example, the female housing 110 is divided into three areas by the inner walls 118. Each area is divided into two layers (upper and lower layers) by a partition wall 181 (see FIGS. 7A to 7E and FIGS. 11A to 11E) installed at a center in a vertical direction thereof, and each layer is provided with two terminal housing chambers 119. In other words, in the present example, the female housing 110 has four terminal housing chambers (a total of twelve terminal housing chambers) 119 provided within each of the three areas partitioned by the inner walls 118. It should be noted that FIG. 4 illustrates a state in which the terminal housing chambers 119 do not house terminals for convenience of explanation.

Figure 5:
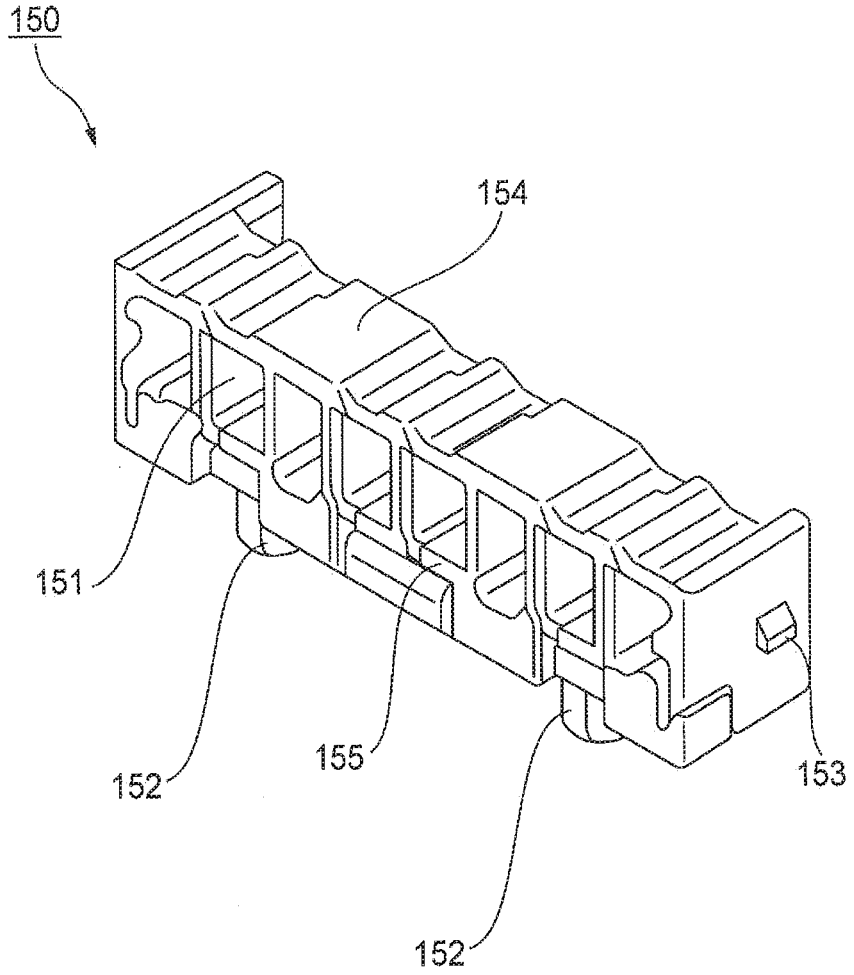
FIG. 5 is a schematic perspective view of a spacer according to the embodiment.

As illustrated in FIG. 5, the spacer (engagement member) 150 is a member having approximately a rectangular parallelepiped shape extended in the transversal direction. The spacer 150 is a member which is vertically movably mounted to the female housing 110, and has a plurality (six in the present example) of terminal housing chambers 151 corresponding to the terminal housing chambers 119 (see FIG. 4) of the lower layers of the female housing 110. Bottom protrusions 152 are installed, respectively, in the vicinities of both sides of a bottom portion of the spacer 150 in the transversal direction, and side protrusions 153 are installed, respectively, at both ends of the spacer 150 in the transversal direction.

Figure 6:
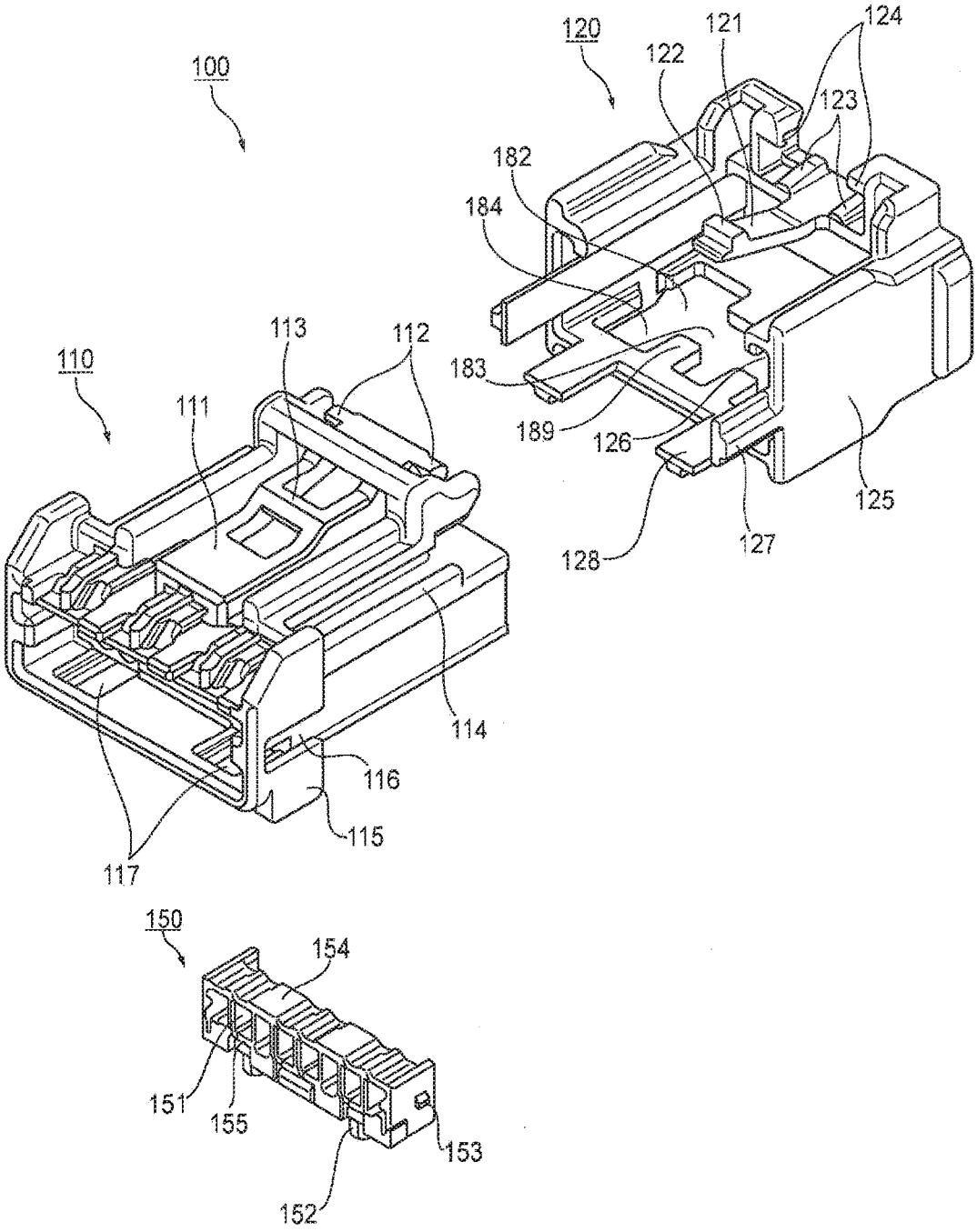
FIG. 6 is a perspective view of a state in which the female housing, the fitting detection member, and the spacer are separated from each other.

As illustrated in FIG. 6, a lower wall of the fitting detection member 120 is provided with a mounting hole 182 for mounting the spacer 150 in the female housing 110 through the fitting detection member 120. A central portion of the mounting hole 182 in the front and rear directions becomes an area (hereinafter, referred to as a 'spacer passing area') 183 through which the spacer 150 passes when the spacer 150 is installed in the female housing 110. A dimension of the spacer passing area 183 in the front and rear directions is set to be slightly larger than that of the spacer 150 in the front and rear directions. An area 184 largely opened in the front and rear directions in both ends of the mounting hole 182 in the transversal direction is provided to facilitate an installation work of the spacer 150 for the fitting detection member 120. The area 184 is installed, such that the fitting detection member 120 can move in the front and rear directions in a state in which the fitting detection member 120 is mounted to the female housing 110 while avoiding interference between the bottom protrusion 152 of the spacer 150 and the lower wall of the fitting detection member 120.

Installation of Terminal

Next, procedures of installing the female terminals 141 in the female housing 110 will be described with reference to FIGS. 7A to 12. FIGS. 7A to 7E illustrates a case where the female terminals 141 are correctly inserted into the female housing 110.

Figure 7A:
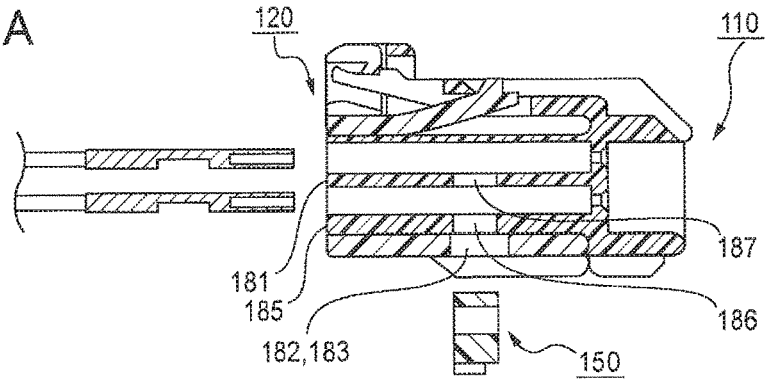
FIG. 7A is a cross-sectional view of a state before the spacer and female terminals are inserted into the female housing, among a series of working operations when the female terminals are connected to the female housing to which the fitting detection member is mounted.

First, as illustrated in FIG. 7A, the female terminals 141 are installed in a state in which the fitting detection member 120 is mounted to the female housing 110 and is then temporarily located at a complete engagement position (of which detailed contents will be described later). As illustrated in FIG. 7A, a lower wall 185 and a partition wall 181 of the female housing 110 each are provided with mounting holes 186 and 187 for mounting the spacer 150. When the fitting detection member 120 is at the complete engagement position, the mounting holes 186 and 187 each are installed at positions at which they are vertically overlaid with the spacer passing area 183 of the fitting detection member 120. Shapes and dimensions of the mounting holes 186 and 187 are selected so that the spacer 150 can be tightly held to be movable vertically.

Figure 7B:
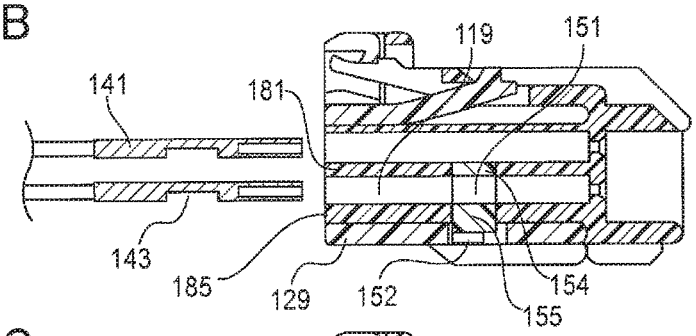
FIG. 7B is a cross-sectional view of a state in which the spacer is mounted to the female housing, among the series of working operations when the female terminals are connected to the female housing to which the fitting detection member is mounted.

Next, as illustrated in FIG. 7B, the spacer 150 is inserted into the mounting holes 186 and 187 of the female housing 110 through the mounting hole 182 of the fitting detection member 120. As illustrated in FIG. 7B, when a lower surface (lower end) of the bottom protrusion 152 of the spacer 150 is flush with a lower surface of a lower wall 129 of the fitting detection member 120, the terminal housing chamber 119 of the lower layer of the female housing 110 and the terminal housing chamber 151 of the spacer 150 are configured to be located at positions at which they accurately communicate with each other. At this time, shapes and dimensions of each part of the spacer 150 are selected so that upper and lower surfaces of an upper wall 154 of the spacer 150 and upper and lower surfaces of the partition wall 181 of the female housing 110 are located without a difference in level therebetween and an upper, surface of a lower wall 155 of the spacer 150 and an upper surface of the lower wall 185 of the female housing 110 are also located without a difference in level therebetween. In the present example, as illustrated in FIG. 7B, when the spacer 150 is inserted, the spacer 150 is held so that the lower surface (lower end) of the bottom protrusion 152 of the spacer 150 is flush with the lower surface of the lower wall of the fitting detection member 120. In this way, the terminal housing chamber 119 of the lower layer of the female housing 110 and the terminal housing chamber 151 of the spacer 150 are located at the positions at which they are accurately in communication with each other.

Figure 7C:
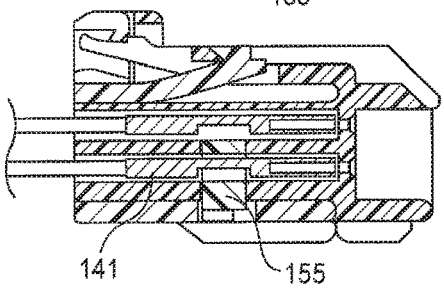
FIG. 7C is a cross-sectional view of a state in which the female terminals are correctly inserted into the female housing, among the series of working operations when the female terminals are connected to the female housing to which the fitting detection member is mounted.

Next, as illustrated in FIG. 7C, the female terminals 141 are inserted into the female housing 110. In the present example, all of the female terminals 141 are correctly inserted up to the deepest portion of the terminal housing chambers 119.

Figure 7D:
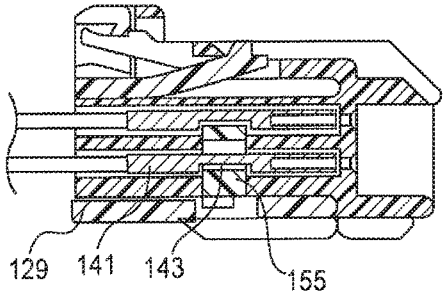
FIG. 7D is a cross-sectional view of a state in which the female terminals inserted into the female housing are engaged with the spacer, among the series of working operations when the female terminals are connected to the female housing to which the fitting detection member is mounted.

Next, as illustrated in FIG. 7D, the spacer 150 is pushed up to an upper limit position (pushed into the female housing 110). Lower portions of the female terminals 141 are provided with recess parts 143. The upper wall 154 and the lower wall 155 of the pushed up spacer 150 are fitted with the recess parts 143 of the female terminals 141, such that the female terminals 141 are engaged by the spacer 150 in a state in which the female terminals 141 are correctly inserted into the female housing 110. In other words, in the present example, the upper wall 154 and the lower wall 155 of the spacer 150 serve as terminal engagement parts and the recess parts 143 of the female terminals 141 serve as engaged parts engaged by the upper wall 154 and the lower wall 155 of the spacer 150. In this way, the female terminals 141 are engaged by the spacer 150.

Figure 8:
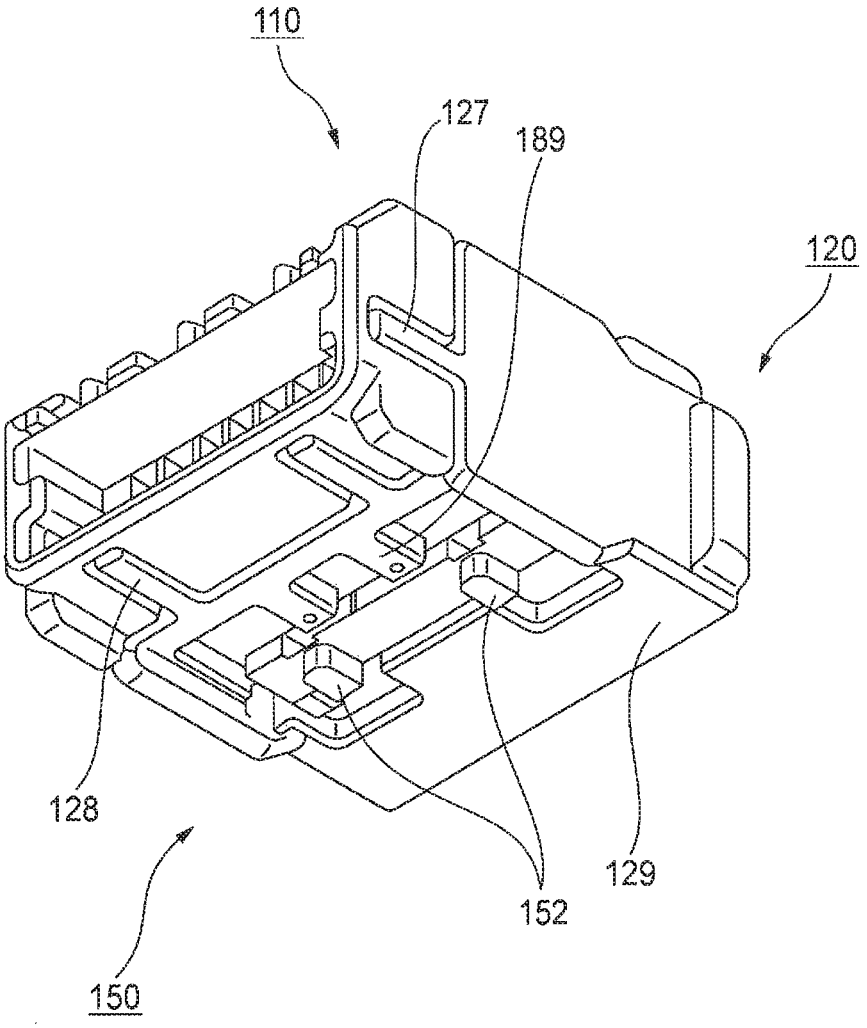
FIG. 8 is a perspective view of the female housing, the fitting detection member, and the spacer in the state of FIG. 7C, viewed from below diagonally.
Figure 9:
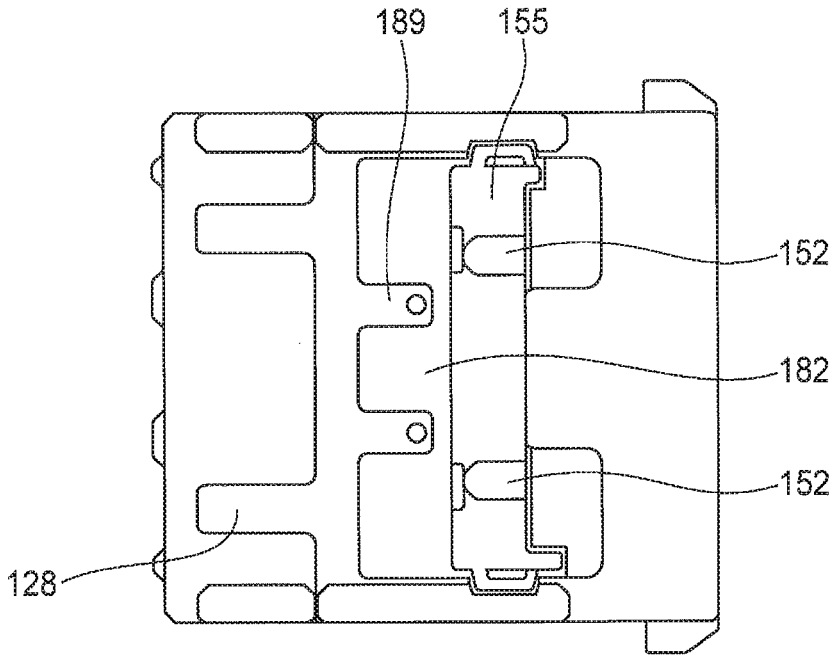
FIG. 9 is a bottom view of the female housing, the fitting detection member, and the spacer in the state of FIG. 7D, viewed from below.

At this point, the lower surface of the lower wall 155 of the spacer 150 is flush with the lower surface of the lower wall 129 of the female housing 110 or enters slightly inwardly of the female housing 110 as compared with the lower surface of the lower wall 129 of the female housing 110 (see FIG. 8). At this time, as illustrated in FIG. 9, the lower surface of the lower wall 155 of the spacer 150 is completely exposed from the mounting hole 182 of the lower wall of the fitting detection member 120.

Figure 7E:
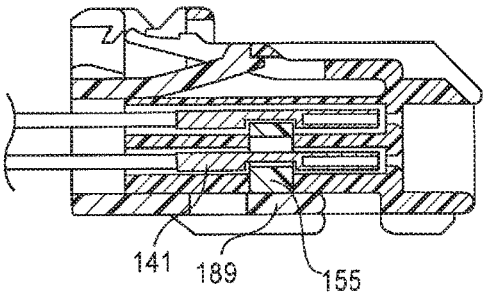
FIG. 7E is a cross-sectional view of a state in which the fitting detection member moves from a complete engagement position to the temporary engagement position, among the series of working operations when the female terminals are connected to the female housing to which the fitting detection member is mounted.

Next, as illustrated in FIG. 7E, the fitting detection member 120 is pulled rearward (leftward in the drawing) to move to a temporary engagement position (of which detailed contents will be described later). Inner surfaces of both side walls of the female housing 110 are provided with abutment parts (not illustrated) onto which the side protrusions 153 of the spacer 150 abut. The corresponding abutment parts (not illustrated) are installed, such that a movement upper limit position of the spacer 150 within the female housing 110 is limited to a position (see FIG. 7D) at which the spacer 150 can correctly engage the female terminals 141. When the spacer 150 is at the movement upper limit position, the lower surface of the lower wall 155 of the spacer 150 is configured to be flush with the lower surface of the lower wall of the female housing 110 or enter slightly inwardly of the female housing 110 as compared with the lower surface of the lower wall of the female housing 110. Therefore, in a state in which the spacer 150 is inserted up to the movement upper limit position within the female housing 110 (i.e., a state in which the spacer 150 is correctly mounted), the fitting detection member 120 does not interfere with the spacer 150, such that the fitting detection member 120 can move to the rear in the front and rear directions. That is, the fitting detection member 120 can move from the complete engagement position to the temporary engagement position.

As a result, since an operator can move the fitting detection member 120 to the temporary engagement position, he/she can check that the female terminals 141 are correctly inserted into the female housing 110.

Figure 10:
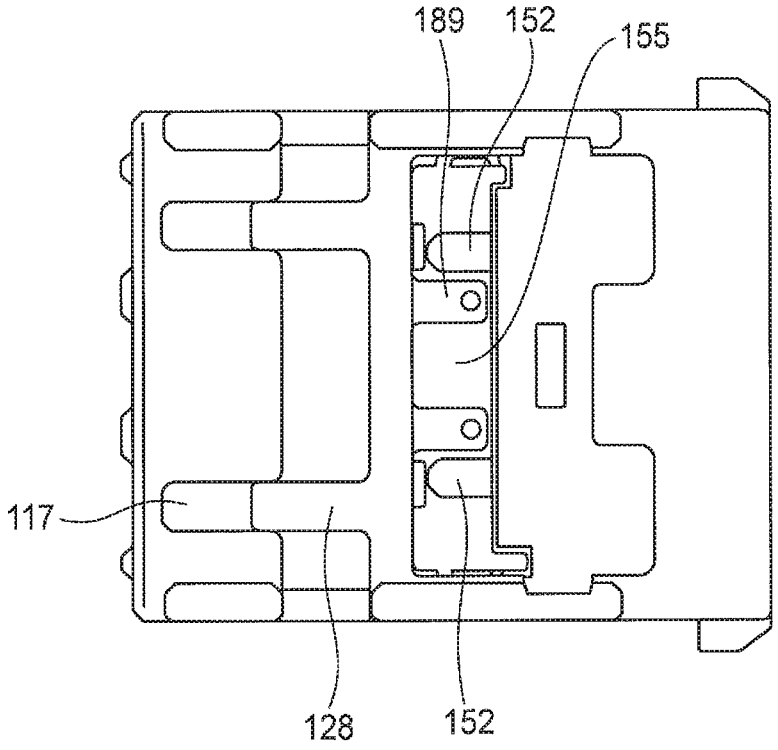
FIG. 10 is a bottom view of the female housing, the fitting detection member, and the spacer in the state of FIG. 7E, viewed from below.

Further, the fitting detection member 120 moves to the temporary engagement position, such that a comb teeth-shaped part 189 of the lower wall 129 of the fitting detection member 120 is overlaid with the lower wall 155 of the spacer 150, as illustrated in FIG. 10. As a result, the comb teeth-shaped part 189 interferes with a downward movement of the spacer 150 to prevent the spacer 150 from being separated from the female terminals 141. As a result, the fitting detection member 120 moves to the temporary engagement position, such that the female terminals 141 are certainly held in a state in which they are engaged by the spacer 150. That is, in the present example, the comb teeth-shaped part 189 serves as a movement prevention part that prevents the movement of the spacer 150.

Figure 11A:
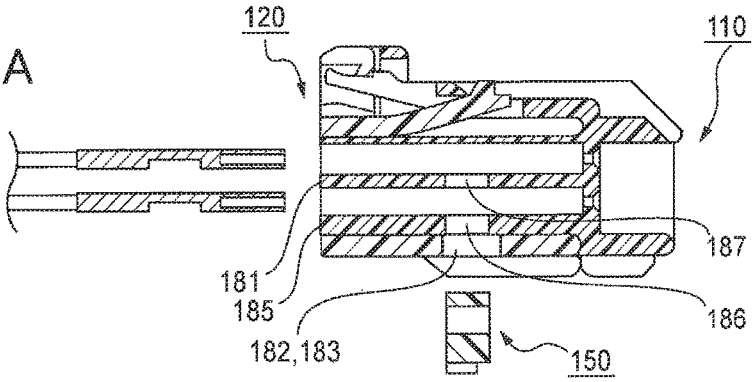
FIG. 11A is the same cross-sectional view as that of FIG. 7A, among a series of working operations when the female terminals are connected to the female housing to which the fitting detection member is mounted.
Figure 11B:
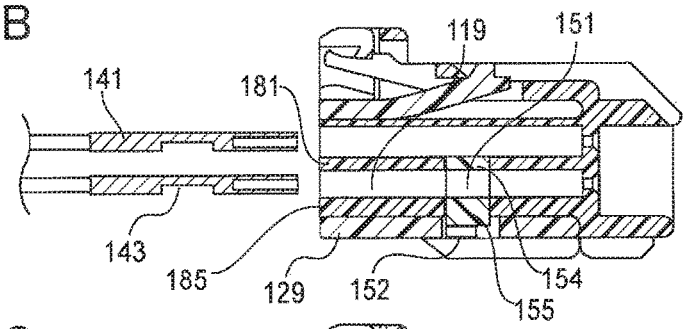
FIG. 11B is the same cross-sectional view as that of FIG. 7B, among the series of working operations when the female terminals are connected to the female housing to which the fitting detection member is mounted.

In contrast, FIGS. 11A to 11E illustrate a case in which the female terminals 141 are incorrectly inserted into the female housing 110. It should be noted that FIGS. 11A to 11B illustrate the same state as those of FIGS. 7A and 7B and descriptions with reference to FIGS. 11A and 11B will thus be omitted.

Figure 11C:
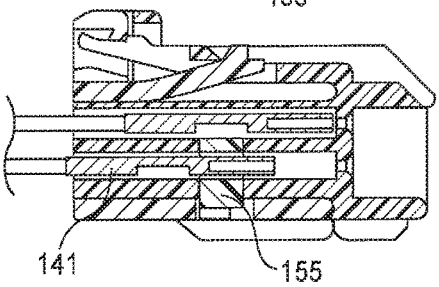
FIG. 11C is a cross-sectional view of a state (halfway insertion state) in which the female terminals are incorrectly inserted into the female housing, among the series of working operations when the female terminals are connected to the female housing to which the fitting detection member is mounted.
Figure 11D:
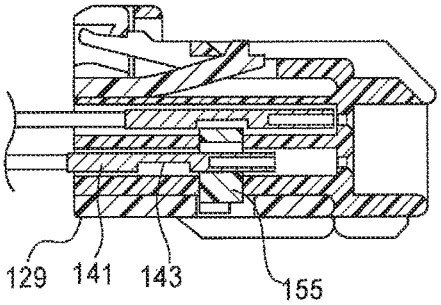
FIG. 11D is a cross-sectional view of a state in which the spacer cannot engage the female terminals inserted into the female housing, among the series of working operations when the female terminals are connected to the female housing to which the fitting detection member is mounted.

As illustrated in FIG. 11C, when the female terminals 141 are incorrectly inserted into the terminal housing chambers 119 of the female housing 110, as illustrated in FIG. 11D, the spacer 150 cannot be pushed up to the upper limit position (pushed into the female housing 110). In an example of FIG. 11D, the female terminal 141 of the upper layer is correctly inserted up to the deepest portion of the terminal housing chamber 119, but the female terminal 141 of the lower layer is inserted halfway, and a part of the female terminal 141 of the lower layer other than the recess part 143 thus interferes with the spacer 150, such that the spacer 150 cannot be pushed up to the upper lower position.

Figure 11E:
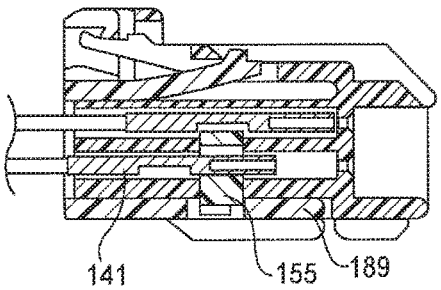
FIG. 11E is a cross-sectional view of a state in which the fitting detection member cannot move from the complete engagement position to the temporary engagement position, among the series of working operations when the female terminals are connected to the female housing to which the fitting detection member is mounted.
Figure 12:
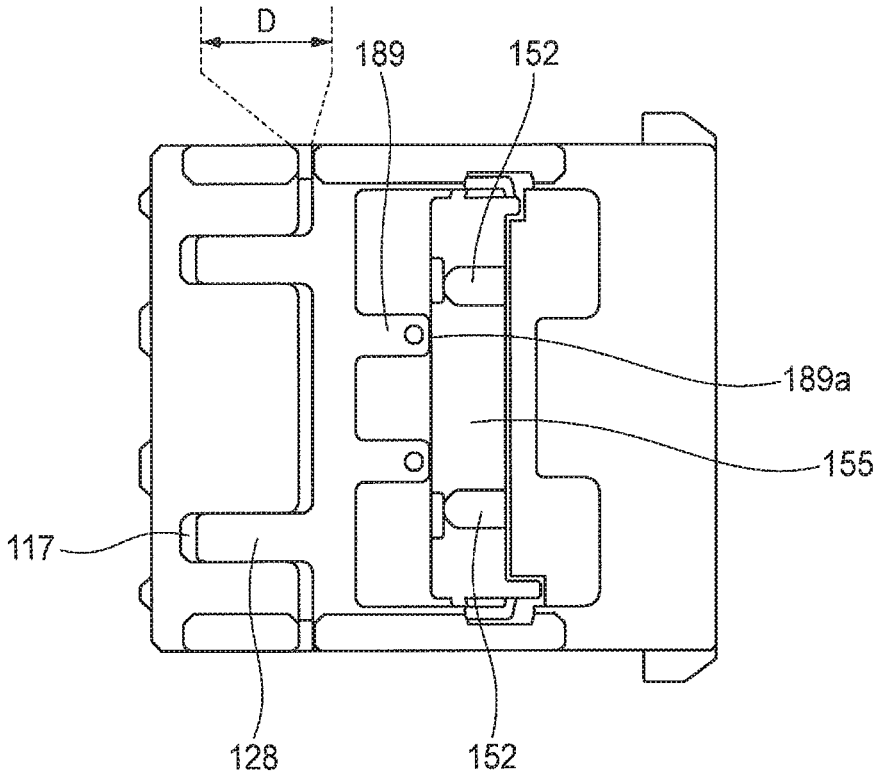
FIG. 12 is a bottom view of the female housing, the fitting detection member, and the spacer in the state of FIG. 11E, viewed from below.

At this time, the lower wall 155 of the spacer 150 protrudes downward from the lower surface of the lower wall 185 of the female housing 110. In this state, as illustrated in FIG. 11E, a distal portion 189*a* of the comb tooth-shaped part 189 of the fitting detection member 120 interferes with the lower wall 155 of the spacer 150, such that the fitting detection member 120 can move to the rear in the front and rear directions only by a slight extra length D (see FIG. 12). The slight extra length D is a length of an extra dimension of the spacer passing area 183 in the front and rear directions with respect to a dimension of a body portion of the spacer 150 in the front and rear directions. Therefore, the fitting detection member 120 cannot move from the complete engagement position to the temporary engagement position. In this way, it can be confirmed that one of the female terminals 141 inserted into the female housing 110 is incorrectly inserted, that is, is inserted halfway. As described above, in the present example, the lower wall 155 of the spacer 150 serves as a halfway fitting detection part.

As described above, in the connector 100, only when the female terminals 141 are correctly inserted into the female housing 110, the female terminals 141 can be engaged by the upper wall (terminal engagement part) 154 and the lower wall (terminal engagement part) 155 of the spacer 150 (FIG. 7D). Further, only when the upper wall (terminal engagement part) 154 and the lower wall (terminal engagement part) 155 of the spacer 150 correctly engage the female terminals 141, the fitting detection member 120 can be moved from the complete engagement position to the rear in the front and rear directions (FIG. 7E).

In contrast, when the female terminals 141 are incorrectly inserted into the female housing 110, the female terminals 141 can be engaged by the upper wall (terminal engagement part) 154 and the lower wall (terminal engagement part) 155 of the spacer 150 (FIG. 11D). Further, even when the female terminals 141 are correctly inserted into the female housing 110, if either the upper wall (terminal engagement part) 154 or the lower wall (terminal engagement part) 155 of the spacer 150 incorrectly engages the female terminal 141, the lower wall (halfway fitting detection part) 155 of the spacer 150 interferes with the fitting detection member 120, such that the fitting detection member 120 cannot move from the complete engagement position to the rear in the front and rear directions.

As a result, it is possible to detect whether the spacer 150 correctly engages the female terminals 141 simultaneously with detecting whether or not the female terminals 141 are correctly inserted into the female housing 110, that is, whether or not there is the halfway insertion terminal depending on whether or not the fitting detection member 120 can move from the complete engagement position to the temporary engagement position.

Further, according to the connector of the present example, when the fitting detection member 120 is at the temporary engagement position, the comb teeth-shaped part 189 protruding to the mounting hole 182 of the fitting detection member 120 is overlaid with the lower wall 155 of the spacer 150, such that the comb teeth-shaped part 189 interferes with the spacer 150 to prevent the spacer 150 from being separated from the female terminal 141, thereby improving reliability in holding the terminals as compared with the conventional connector.

Furthermore, according to the connector of the present example, only when all of a plurality of female terminals 141 housed in the female housing 110 are correctly inserted, the spacer 150 can engage the plurality of corresponding female terminals 141. Further, only when the spacer 150 correctly engages the plurality of corresponding female terminals 141, the fitting detection member 120 can move from the complete engagement position to the temporary engagement position. As a result, it is possible to detect whether or not all of the plurality of female terminals 141 housed in the female housing 110 are correctly inserted depending on whether or not the fitting detection member 120 can move from the complete engagement position to the temporary engagement position.

Fitting of Connector

Next, procedures of fitting the connector 100 will be described with reference to FIGS. 13A to 16B.

Figure 13A:
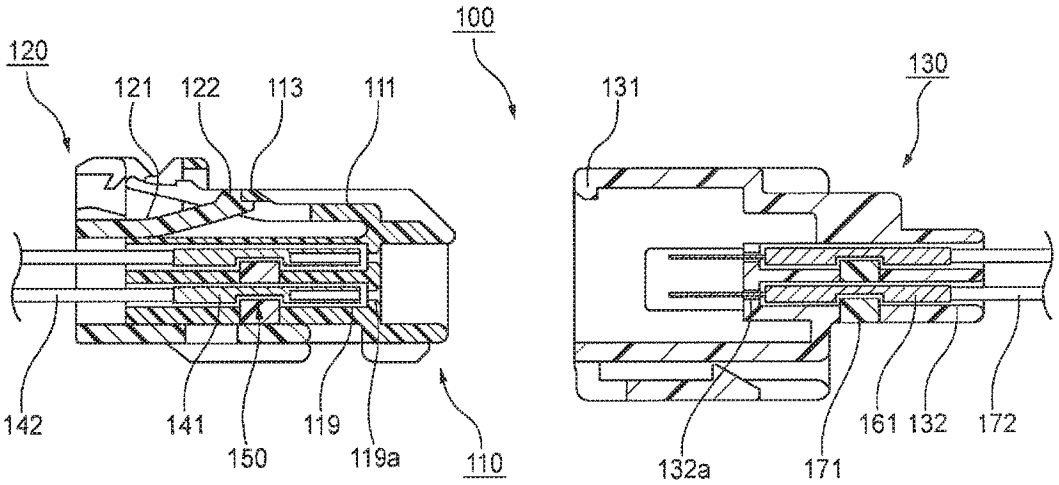
FIG. 13A is a cross-sectional view of the female housing and the fitting detection member, and a male housing according to the embodiment in a state before the female housing and the fitting detection member are fitted with the male housing (a state in which the female housing and the fitting detection member are separated from the male housing), taken along line A-A of FIG. 4.
Figure 13B:
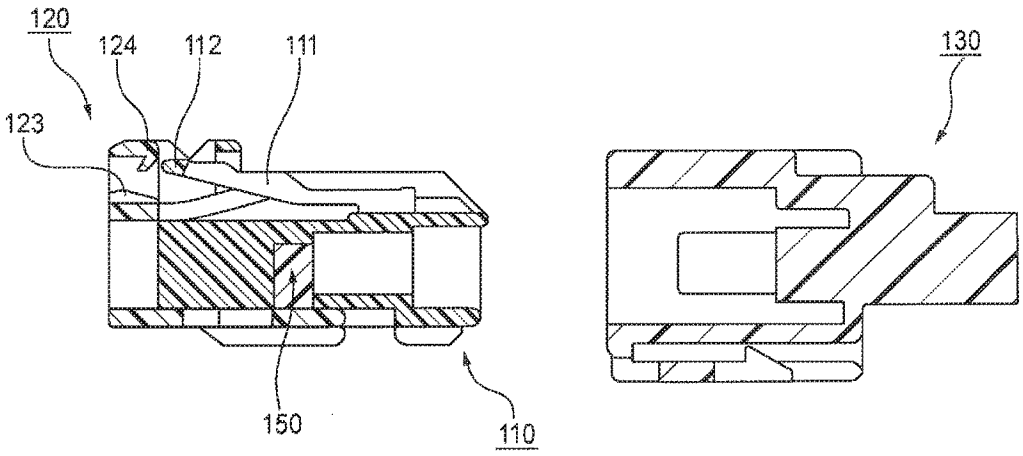
FIG. 13B is a cross-sectional view of the female housing and the fitting detection member, and the male housing according to the embodiment in the state before the female housing and the fitting detection member are fitted with the male housing (the state in which the female housing and the fitting detection member are separated from the male housing), taken along line B-B of FIG. 4.

First, as illustrated in FIG. 13A, at a point in time before the fitting of the connector 100 starts, the female housing 110 (see FIG. 3) onto which the fitting detection member 120 is inserted from the rear is separated from the male housing 130. The male housing 130 has an engaging part (second locked part) 131 corresponding to the male housing engaging part 113 of the female housing 110 and terminal housing chambers 132. At this point in time, the detection protrusion 122 of the fitting detection member 120 abuts onto the rear wall surface of the male housing engaging part 113 of the female housing 110, such that the relative forward movement of the fitting detection member 120 with respect to the female housing 110 is prevented. Further, as illustrated in FIG. 13B, at this point in time, the fitting detection member engaging part 112 of the female housing 110 and the engaging part 124 of the fitting detection member 120 are spaced from each other.

At this point, female terminals 141 housed in the terminal housing chambers 119 of the female housing 110 are separated from male terminals 161 housed in the terminal housing chambers 132 of the male housing 130. Further, the female terminals 141 are engaged by spacers 150 (and lances (not illustrated) or the like), and the male terminals 161 are engaged by spacers 171 (and lances (not illustrated) or the like). Electric wires 142 are extended behind the female terminals 141, and electric wires 172 are extended behind the male terminals 161.

Figure 14A:
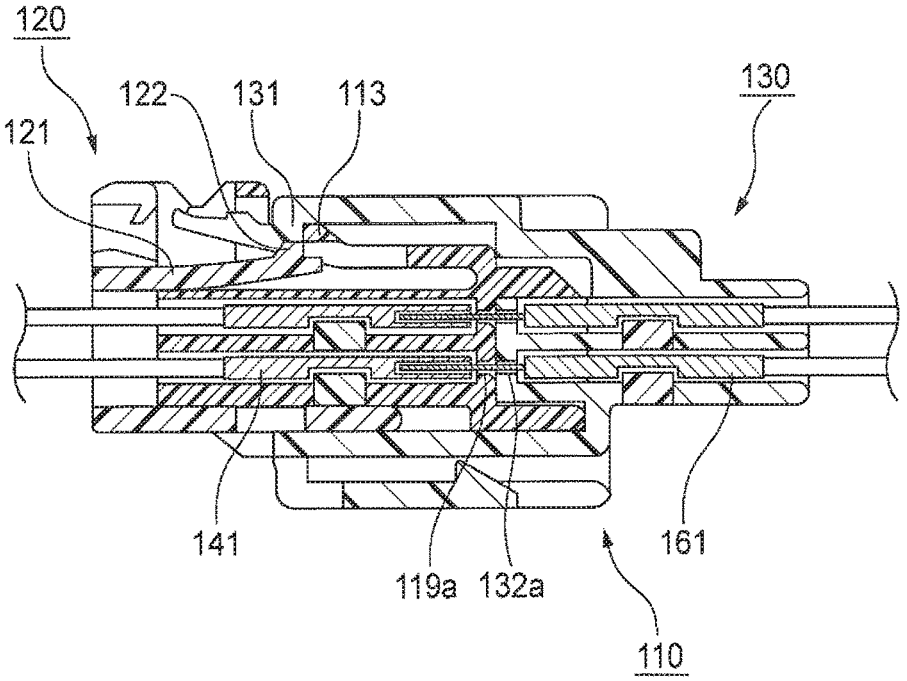
FIG. 14A is a cross-sectional view of the female housing and the fitting detection member, and the male housing in a state while the female housing and the fitting detection member are fitted with the male housing (a state in which the female housing is fitted with the male housing), taken along line A-A of FIG. 4.

Next, as illustrated in FIG. 14A, if the fitting of the connector 100 starts, the female housing 110 to which the fitting detection member 120 is mounted is inserted into the male housing 130. In detail, if an operator pushes the fitting detection member 120 toward the male housing 130, the relative forward movement of the fitting detection member 120 with respect to the female housing 110 is prevented, such that the female housing 110 (and the fitting detection member 120) approaches the male housing 130.

At this time, since a front wall surface of the male housing engaging part 113 of the female housing 110 is inclined with respect to the fitted direction, the engaging part 131 of the male housing 130 is seated on the male housing engaging part 113 and then climbs over the male housing engaging part 113. As a result, the engaging part 131 of the male housing 130 is engaged with the male housing engaging part 113. Further, at this time, the detection protrusion 122 of the fitting detection member 120 is pressed down by the engaging part 131. The detection lock arm 121 is deflected downward by the detection protrusion 122 pressed down as described above. It should be noted that FIG. 14A illustrates an arrangement of the male housing engaging part 113, the detection protrusion 122, and the engaging part 131 at this point in time.

At this point in time, distal ends of the male terminals 161 protruding from terminal protruding holes 132*a* of the male housing 130 pass through terminal insertion holes 119*a* in the female housing 110 and are then inserted into the female terminals 141. Therefore, the female terminals 141 and the male terminals 161 are electrically connected to each other. In addition, at this point in time, an inner wall surface of the female housing 110 provided with the terminal inserting holes 119*a* and an inner wall surface of the male housing 130 provided with the terminal protruding holes 132*a* abut onto each other. As a result, the female housing 110 and the male housing 130 can no longer approach each other.

Figure 14B:
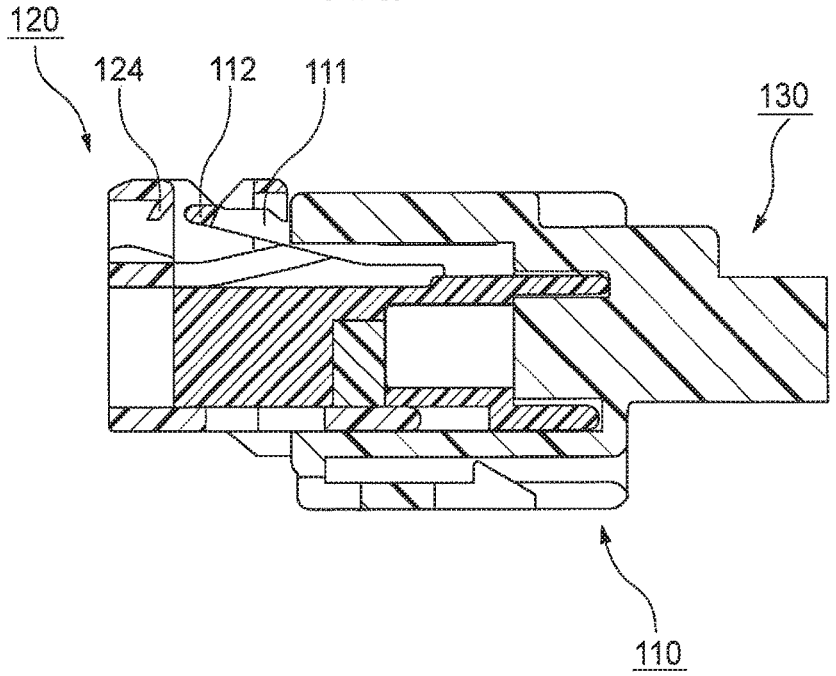
FIG. 14B is a cross-sectional view of the female housing and the fitting detection member, and the male housing in the state while the female housing and the fitting detection member are fitted with the male housing (the state in which the female housing is fitted with the male housing), taken along line B-B of FIG. 4.

Meanwhile, as illustrated in FIG. 14B, at this point in time, the fitting detection member engaging part 112 of the female housing 110 and the engaging part 124 of the fitting detection member 120 are separated from each other, and are not engaged with each other.

Figure 15A:
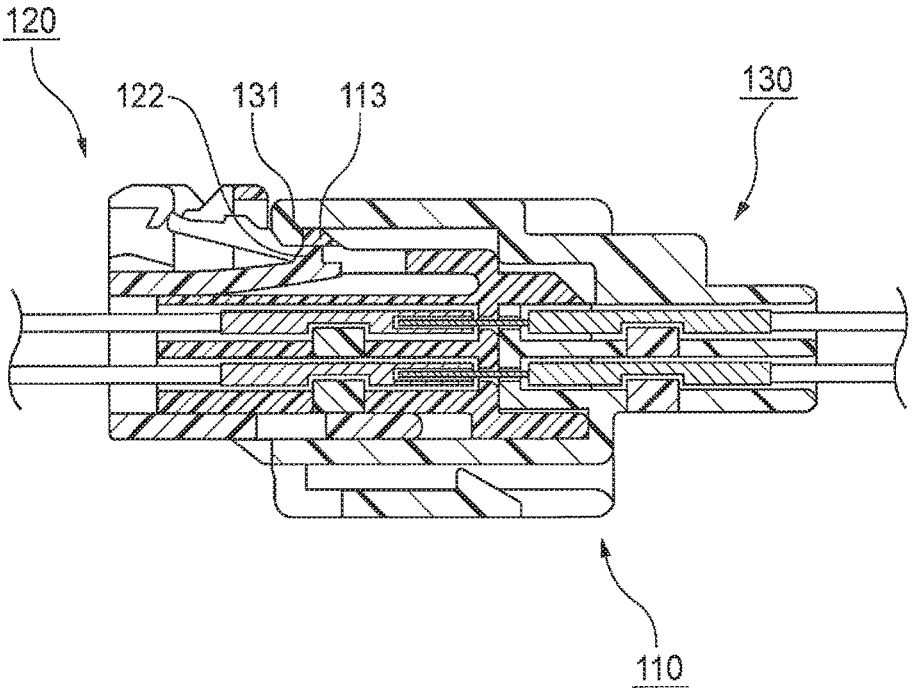
FIG. 15A is a cross-sectional view of the female housing and the fitting detection member, and the male housing in a state while the female housing and the fitting detection member are fitted with the male housing (while the fitting detection member moves to a complete engagement position), taken along line A-A of FIG. 4.
Figure 15B:
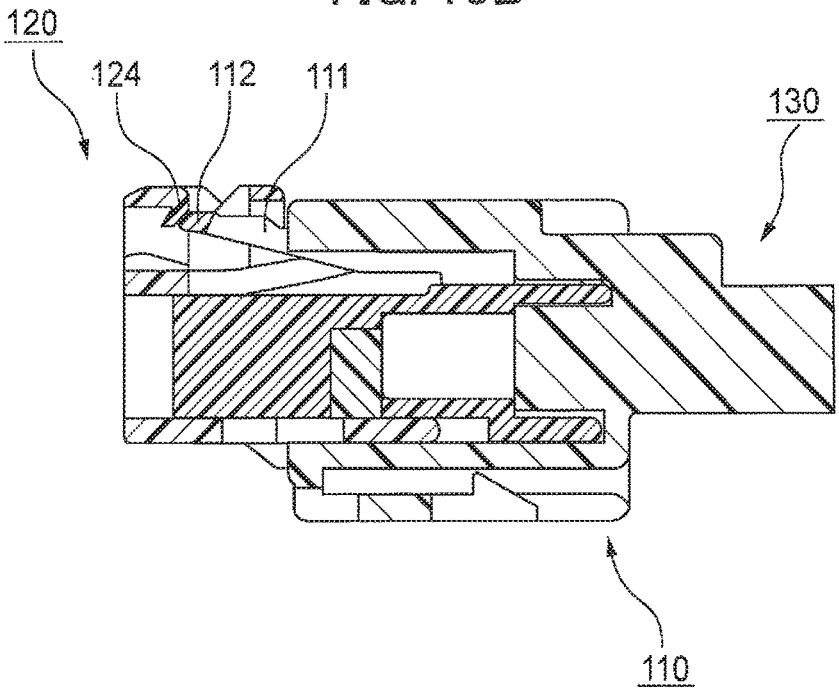
FIG. 15B is a cross-sectional view of the female housing and the fitting detection member, and the male housing in the state while the female housing and the fitting detection member are fitted with the male housing (while the fitting detection member moves to the complete engagement position), taken along line B-B of FIG. 4.

Next, as illustrated in FIG. 15A, if the fitting detection member 120 in a state of FIG. 14A is further pushed toward the male housing 130, the detection protrusion 122 of the fitting detection member 120 passes under the male housing engaging part 113 and then moves toward the male housing 130. As a result, the entire fitting detection member 120 approaches the male housing 130. Meanwhile, even if the fitting detection member 120 moves in this way, the female housing 110 cannot move forward as described above. For this reason, at this point in time, as illustrated in FIG. 15B, the engaging part 124 of the fitting detection member 120 and the fitting detection member engaging part 112 of the female housing 110 come into contact with each other. Since a rear wall surface of the fitting detection member engaging part 112 is inclined with respect to the fitted direction and a front wall surface of the engaging part 124 is also inclined with respect to the fitted direction, the fitting lock arm 111 is guided to the inclined surfaces and thus starts to be deflected downward.

Next, as illustrated in FIG. 16A, if the fitting detection member 120 in a state of FIG. 15A is further pushed toward the male housing 130, the detection protrusion 122 of the fitting detection member 120 passes under the male housing engaging part 113 of the female housing 110 and then moves to the front of the male housing engaging part 113 to be thus engaged with the male housing engaging part 113. Further, as illustrated in FIG. 16B, at this point in time, the fitting detection member engaging part 112 of the female housing 110 and the engaging part 124 of the fitting detection member 120 are engaged with each other.

At this point in time, the abutting walls 125 of the fitting detection member 120 abut onto the abutting walls 115 (see FIG. 3) of the female housing 110. Therefore, the fitting detection member 120 cannot move forward beyond this position.

If the fitting detection member 120 is at a position illustrated in FIGS. 16A and 16B, the fitting detection member engaging part 112 of the female housing 110 and the engaging part 124 of the fitting detection member 120 are engaged with each other. Therefore, in this case, the fitting detection member 120 cannot move rearward, such that fitting detection member 120 and the female housing 110 cannot be separated from each other. In other words, the fitting detection member 120 is in a state in which it is completely engaged with the female housing 110. Therefore, the position of the fitting detection member 120 illustrated in FIGS. 16A and 16B is also referred to as a "complete engagement position".

As described above, the fitting of the female housing 110 with the male housing 130 starts in a state in which the fitting detection member 120 is in the temporary engagement position, and the fitting detection member 120 reaches the complete engagement position by the fitting of the female housing 110 with the male housing 130 (electrical connection between the female terminals 141 and the male terminals 161). At this point, the fitting of the connector 100 is completed. Accordingly, the connector 100 can detect a fitted state (further forward movement from the temporary engagement position) and perform the engagement of the fitting detection member 120 (engagement at the complete engagement position) only by pushing the fitting detection member 120 toward the male housing 130.

Release of Fitting of Connector

Next, procedures of releasing the fitting of the connector 100 (separating the female housing 110 from the male housing 130 to release the electrical connection between the female terminals 141 and the male terminals 161) will be described with reference to FIGS. 17A to 18B.

Figure 17A:
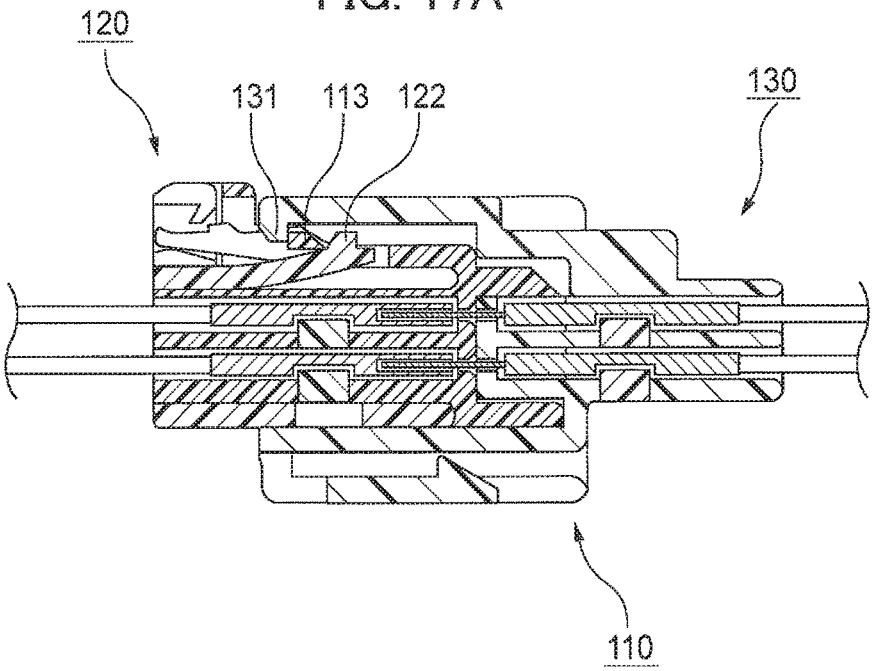
FIG. 17A is a cross-sectional view of the female housing and the fitting detection member, and the male housing in a state while the fitting is released (a state in which engagement between the fitting detection member and the female housing is released), taken along line A-A of FIG. 4.
Figure 17B:
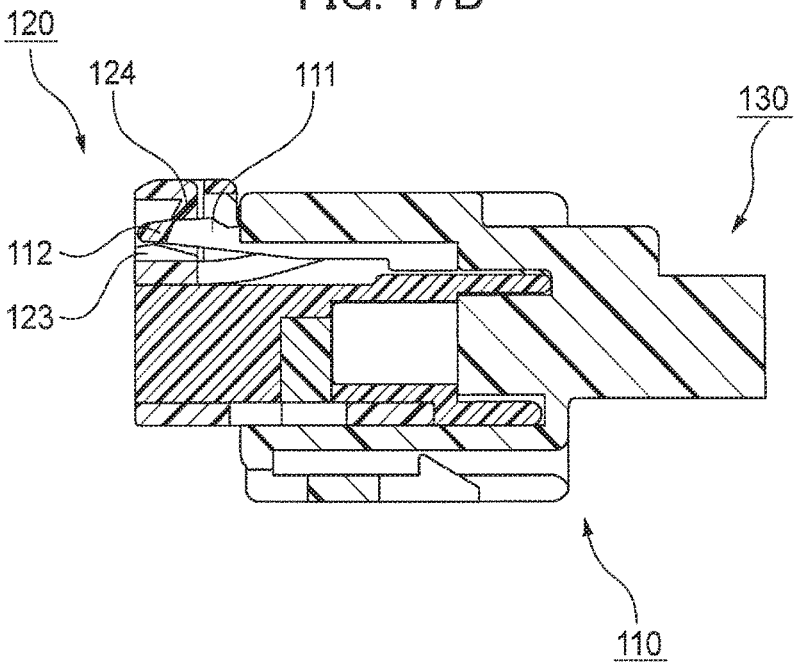
FIG. 17B is a cross-sectional view of the female housing and the fitting detection member, and the male housing in the state while the fitting is released (the state in which the engagement between the fitting detection member and the female housing is released), taken along line B-B of FIG. 4.

First, as illustrated in FIG. 17B, the fitting lock arm 111 of the female housing 110 is deflected downward so that the fitting detection member engaging part 112 of the female housing 110 and the engaging part 124 of the fitting detection member 120 of the connector 100 (see FIGS. 16A and 16B) of which the fitting is completed are separated from each other. Both the fitting detection member engaging part 112 and the male housing engaging part 113 that are provided at the fitting lock arm 111 move downward by the deflection.

At this time, since the fitting lock arm 111 abuts onto the deflection regulator 123 of the fitting detection member 120 located thereunder, a deflection amount of the fitting lock arm 111 is restricted. As a result of the restriction, as illustrated in FIG. 17B, the engagement between the fitting detection member engaging part 112 and the engaging part 124 is released, but as illustrated in FIG. 17A, the engagement between the engaging part 131 of the male housing 130 and the male housing engaging part 113 is not released. In other words, the deflection regulator 123 regulates the deflection amount of the fitting lock arm 111 to be in a range in which the engagement of the male housing engaging part 113 cannot be released while the engagement of the fitting detection member engaging part 112 can be released. Therefore, at this point in time, the female housing 110 and the male housing 130 cannot be separated from each other.

Figure 18A:
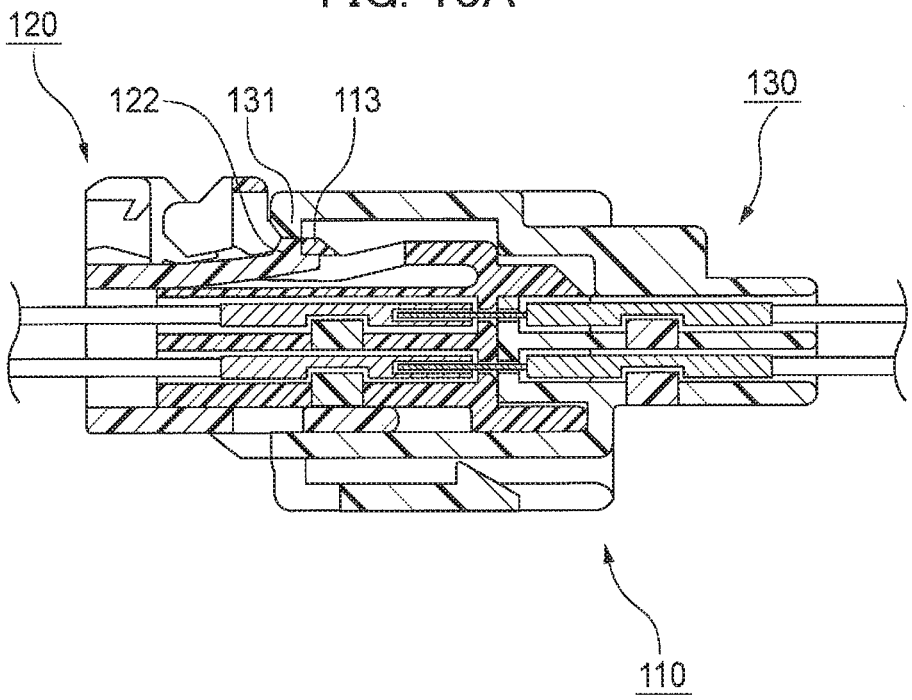
FIG. 18A is a cross-sectional view of the female housing and the fitting detection member, and the male housing in a state while the fitting is released (a state in which the fitting detection member returns to the temporary engagement position), taken along line A-A of FIG. 4.
Figure 18B:
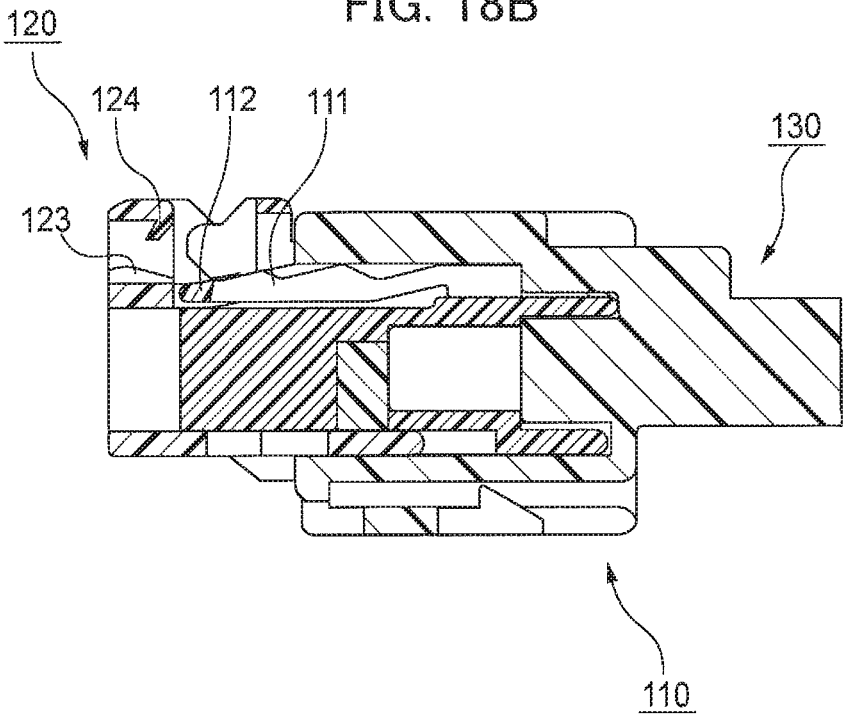
FIG. 18B is a cross-sectional view of the female housing and the fitting detection member, and the male housing in the state while the fitting is released (the state in which the fitting detection member returns to the temporary engagement position), taken along line B-B of FIG. 4.

Next, as illustrated in FIG. 18A, if the fitting detection member 120 in a state of FIG. 17A is pulled to be far away from the male housing 130, a rear wall surface of the detection protrusion 122 of the fitting detection member 120 is inclined with respect to the fitted direction, such that the detection protrusion 122 moves to pass under the male housing engaging part 113 of the female housing 110. That is, the fitting detection member 120 moves from the complete engagement position toward the temporary engagement position. As a result, as illustrated in FIG. 18B, the deflection regulator 123 moves rearward along with the fitting detection member 120, such that the fitting lock arm 111 of the female housing 110 becomes far away from the deflection regulator 123. Therefore, the regulation of the deflection amount of the fitting lock arm 111 is released, such that the fitting lock arm 111 can be further deflected downward.

In this state, if the fitting lock arm 111 is further deflected downward, as illustrated in FIG. 18A, the male housing engaging part 113 moves downward beyond the engaging part 131 of the male housing 130, such that the engagement between the male housing engaging part 113 and the engaging part 131 is released. In other words, the female housing 110 and the male housing 130 are in a state in which they can be separated from each other. In this state, if the fitting detection member 120 and the female housing 110 move rearward, the female housing 110 and the male housing 130 are separated from each other (return to the state illustrated in FIGS. 13A and 13B).

As described above, the fitting between the female housing 110 and the male housing 130 starts to be released (separated) in a state in which the fitting detection member 120 is at the complete engagement position to deflect the fitting lock arm 111, thereby releasing the engagement between the fitting detection member 120 and the female housing 110 (engagement between the fitting detection member engaging part 112 and the engaging part 124) and then moving the fitting detection member 120 toward the temporary engagement position. In this state, the fitting lock arm 111 is further deflected to release the engagement between the female housing 110 and the male housing 130. In other words, when the fitting of the connector 100 is released, two operations of releasing (first releasing) the engagement between the fitting detection member 120 and the female housing 110 and releasing (second releasing) the engagement between the female housing 110 and the male housing 130 are performed. Therefore, in the connector 100, the unintentional release of the fitting of the connector can be more certainly prevented, as compared with the conventional connector.

In addition, since a deflection direction of the fitting lock arm 111 for releasing the engagement of the fitting detection member engaging part 112 and a deflection direction of the fitting lock arm 111 for releasing the engagement of the male housing engaging part 113 are the same as each other (for example, a downward direction in FIGS. 17A and 17B), a series of operations of performing the above-mentioned first releasing, the movement of the fitting detection member 120 toward the temporary engagement position, and the above-mentioned second releasing can be continuously performed just like a single operation. Therefore, in the connector 100, the unintentional release of the fitting of the connector can be prevented, and the fitting of the connector can be easily released when the fitting of the connector is intentionally released.

Here, the respective features of the embodiments of the connector according to the present disclosure described above are simply arranged in the following 1) to 3).

1) A connector (100) includes: a first housing (110) capable of housing a terminal (141); a second housing (130) capable of housing a mating terminal (161); a fitting detection member (120) capable of detecting a fitted state between the first housing (110) and the second housing (130); and an engagement member (150) capable of engaging the terminal (141) housed in the first housing (110). The first housing (110) includes: a fitting lock arm (111) extending toward a rear in a fitting direction; a first locking part (112) provided in the fitting lock arm (111) and engageable with the fitting detection member (120); and a second locking part (113) provided in the fitting lock arm (111) and engageable with the second housing (130). The fitting detection member (120) includes: a detection lock arm (121) extending toward a front in the fitting direction; a detection protrusion (122) provided in the detection lock arm (121); a deflection regulator (123) capable of regulating a deflection amount of the fitting lock arm (111); and a first locked part (124) corresponding to the first locking part (112). The second housing (130) includes a second locked part (131) corresponding to the second locking part (113). When the connector (100) is fitted, the fitting detection member (120) is mounted to the first housing (110) from the rear of the fitting direction and moved from a temporary engagement position to a complete engagement position. The temporary engagement position is at which the detection protrusion (122) is in contact with the second locking part (113) and a movement of the fitting detection member (120) toward the front in the fitting direction is prevented. The complete engagement position is at which the contact of the detection protrusion (122) with the second locking part (113) is released by the second locked part (131) engaged with the second locking part (113) and the fitting detection member (120) moves toward the front in the fitting direction and at which the first locked part (124) is engaged with the first locking part (112). When the fitting detection member (120) is located at the complete engagement position, the deflection regulator (123) regulates the deflection amount of the fitting lock arm (111) within a range in which an engagement between the second locking part (113) and the second locked part (131) is unreleasable while an engagement between the first locking part (112) and the first locked part (124) is releasable. When the terminal (141) is housed in the first housing (110) before the connector (100) is fitted, and when the engagement member (150) is mounted to the first housing (110) in a state where the fitting detection member (120) is temporarily located at the complete engagement position, the engagement member (150) is located at a correct position if the terminal (141) is correctly housed in the first housing (110) and the engagement member (150) is located at an incorrect position if the terminal (141) is incorrectly housed in the first housing (110). When the engagement member (150) is located at the correct position, the fitting detection member (120) does not interfere with the engagement member (150) and is movable from the complete engagement position to the temporary engagement position. When the engagement member (150) is located at the incorrect position, the fitting detection member (120) interferes with the engagement member (150) and is not movable from the complete engagement position to the temporary engagement position.

2) In the connector (100) of above 1), the fitting detection member (120) is inserted onto the first housing (110), and the fitting detection member (120) includes a movement prevention part (189) configured to prevent a movement of the engagement member (150) from the correct position to the incorrect position when the fitting detection member (120) is located at the temporary engagement position.

3) In the connector (100) of above 1) or 2), the first housing (110) is capable of housing a plurality of terminals (141), and the engagement member (150) is located at the incorrect position when at least one terminal of the plurality of terminals (141) is incorrectly housed in the first housing (110).

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A connector comprising:

a first housing configured to house a terminal;

a second housing configured to house a mating terminal and fittable with the first housing;

a fitting detection member mounted from a rear of the first housing in a first direction in which the first housing approaches the second housing in a fitted direction between the first housing and the second housing, the fitting detection member being configured to detect a fitted state between the first housing and the second housing; and an engagement member mounted to the first housing and configured to engage the terminal housed in the first housing, wherein the first housing comprises:

a fitting lock arm extending toward a second direction opposite to the first direction;

a first locking part provided in the fitting lock arm and engageable with the fitting detection member; and a second locking part provided in the fitting lock arm and engageable with the second housing, the fitting detection member comprises:

a detection lock arm extending toward the first direction;

a detection protrusion provided in the detection lock arm;

a deflection regulator configured to regulate a deflection amount of the fitting lock arm; and a first locked part engageable with the first locking part, the second housing comprises a second locked part engageable with the second locking part, the fitting detection member is movable between a temporary engagement position and a complete engagement position, the temporary engagement position at which a contact between the detection protrusion and the second locking part prevents a movement of the fitting detection member in the first direction, the complete engagement position to which the fitting detection member moves from the temporary engagement position in the first direction and at which the first locked part is engaged with the first locking part, the second locked part engaged with the second locking part releases the contact between the detection protrusion and the second locking part located at the temporary engagement position and allows the fitting detection member to move in the first direction, the deflection regulator of the fitting detection member located at the complete engagement position regulates the deflection amount of the fitting lock arm within a range in which an engagement between the second locking part and the second locked part is unreleasable while an engagement between the first locking part and the first locked part is releasable, the engagement member mounted to the first housing with the fitting detection member located at the complete engagement position is located at a correct position with the terminal correctly housed in the first housing and is located at an incorrect position with the terminal incorrectly housed in the first housing, the engagement member located at the correct position does not interfere with the fitting detection member and allows a movement of the fitting detection member from the complete engagement position to the temporary engagement position, and the engagement member located at the incorrect position interferes with the fitting detection member and prevents the movement of the fitting detection member from the complete engagement position to the temporary engagement position.

2. The connector of claim 1, wherein the fitting detection member is inserted onto the first housing, and the fitting detection member located at the temporary engagement position comprises a movement prevention part configured to prevent a movement of the engagement member from the correct position to the incorrect position.

3. The connector of claim 1, wherein the first housing is configured to house a plurality of terminals, and the engagement member is located at the incorrect position with at least one terminal of the plurality of terminals incorrectly housed in the first housing.

* * * * *